US008573657B2

(12) United States Patent
Papanikolaou et al.

(10) Patent No.: US 8,573,657 B2
(45) Date of Patent: Nov. 5, 2013

(54) LATCH MECHANISM

(75) Inventors: Kosta Papanikolaou, Huntington Woods, MI (US); Venky Krishnan, Wayne, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 718 days.

(21) Appl. No.: 12/402,768

(22) Filed: Mar. 12, 2009

(65) Prior Publication Data

US 2010/0235058 A1 Sep. 16, 2010

(51) Int. Cl.
*E05C 3/06* (2006.01)
*E05C 3/16* (2006.01)

(52) U.S. Cl.
USPC ..... 292/201; 292/216; 292/DIG. 23; 292/DIG. 65

(58) Field of Classification Search
USPC ..... 292/112, 199, 201, 216, 279, 280, 292/336.3, DIG. 12, DIG. 23, DIG. 25, 292/DIG. 65; 49/280; 70/237
See application file for complete search history.

(56) References Cited

U.S. PATENT DOCUMENTS 3,479,767 A * 11/1969 Lastinger et al. ..... 49/280
4,672,348 A * 6/1987 Duve ..... 336/192
4,674,781 A * 6/1987 Reece et al. ..... 292/336.3
4,702,117 A 10/1987 Tsutsumi et al.
4,848,031 A 7/1989 Yamagishi et al.
4,929,007 A 5/1990 Bartczak et al.
5,618,068 A 4/1997 Mitsui et al.
5,632,515 A 5/1997 Dowling
5,644,869 A * 7/1997 Buchanan, Jr. ..... 49/362
5,802,894 A 9/1998 Jahrsetz et al.
5,896,768 A 4/1999 Cranick et al.
5,901,991 A * 5/1999 Hugel et al. ..... 292/201
5,921,612 A 7/1999 Mizuki et al.
6,050,117 A * 4/2000 Weyerstall ..... 70/277
6,065,316 A * 5/2000 Sato et al. ..... 70/264
6,125,583 A 10/2000 Murray et al.
6,256,932 B1 7/2001 Jyawook et al.
6,361,091 B1 3/2002 Weschler
6,470,719 B1 10/2002 Franz et al.
6,523,376 B2 2/2003 Baukholt et al.
6,550,826 B2 * 4/2003 Fukushima et al. ..... 292/201

(Continued)

OTHER PUBLICATIONS

U.S. Appl. No. 11/164,369, Office Action mailed Mar. 20, 2007.

(Continued)

*Primary Examiner* — Carlos Lugo
*Assistant Examiner* — Alyson M Merlino
(74) *Attorney, Agent, or Firm* — Raymond Coppiellie; Price Heneveld LLP

(57) ABSTRACT

A latch system for a door of a vehicle a latch assembly having a catch and a pawl, an actuatable inside handle, a linkage assembly mechanically linked between the inside handle and the latch assembly, and an actuator interconnected to the pawl and being configured to be activated by actuation of the inside handle. The catch is configured to be moved to the open position by activating the actuator to thereby move the pawl to stop the pawl from maintaining the catch in the closed position or by actuating the inside handle when the vehicle has power. The catch is also configured to be moved to the open position after actuation of the inside handle by having the inside handle mechanically move the linkage assembly to stop the pawl from maintaining the catch in the closed position when the vehicle does not have power.

9 Claims, 21 Drawing Sheets

(56) References Cited

U.S. PATENT DOCUMENTS

| | | | | |
|---|---|---|---|---|
| 6,554,328 | B2 | 4/2003 | Cetnar et al. | |
| 6,629,711 | B1 | 10/2003 | Gleason et al. | |
| 6,701,671 | B1 * | 3/2004 | Fukumoto et al. | 49/280 |
| 6,883,839 | B2 * | 4/2005 | Belmond et al. | 292/201 |
| 7,070,213 | B2 * | 7/2006 | Willats et al. | 292/216 |
| 7,192,076 | B2 * | 3/2007 | Ottino | 296/146.1 |
| 7,222,459 | B2 * | 5/2007 | Taniyama | 49/280 |
| 7,325,843 | B2 * | 2/2008 | Coleman et al. | 292/216 |
| 7,399,010 | B2 | 7/2008 | Hunt et al. | |
| 2001/0005078 | A1 * | 6/2001 | Fukushima et al. | 292/201 |
| 2003/0222463 | A1 * | 12/2003 | Mejean et al. | 292/216 |
| 2004/0195845 | A1 | 10/2004 | Chevalier | |
| 2007/0126243 | A1 * | 6/2007 | Papanikolaou et al. | 292/201 |
| 2008/0022736 | A1 * | 1/2008 | Kouzuma | 70/237 |
| 2008/0250718 | A1 * | 10/2008 | Papanikolaou et al. | 49/287 |
| 2010/0052337 | A1 | 3/2010 | Arabia, Jr. et al. | |
| 2010/0235057 | A1 * | 9/2010 | Papanikolaou et al. | 701/49 |
| 2010/0235059 | A1 * | 9/2010 | Krishnan et al. | 701/49 |

OTHER PUBLICATIONS

U.S. Appl. No. 11/164,369, Response filed May 29, 2007.
U.S. Appl. No. 11/164,369, Office Action mailed Aug. 7, 2007.
U.S. Appl. No. 11/164,369, Response filed Dec. 3, 2007.
U.S. Appl. No. 11/164,369, Office Action mailed Feb. 11, 2008.
U.S. Appl. No. 11/164,369, Response filed May 7, 2008.
U.S. Appl. No. 11/164,369, Office Action mailed Aug. 25, 2008.
U.S. Appl. No. 11/164,369, Request for Continued Examination/ Amendment filed Nov. 11, 2008.
U.S. Appl. No. 11/164,369, Office Action mailed Jan. 21, 2009.
U.S. Appl. No. 11/164,369, Response filed Apr. 14, 2009.
U.S. Appl. No. 11/164,369, Office Action mailed Jul. 22, 2009.
U.S. Appl. No. 11/164,369, Response filed Sep. 22, 2009.
U.S. Appl. No. 11/164,369, Office Action mailed Oct. 7, 2009.
U.S. Appl. No. 11/164,369, Request for Continued Examination/ Amendment filed Nov. 23, 2009.
U.S. Appl. No. 11/164,369, Office Action mailed Dec. 23, 2009.
U.S. Appl. No. 11/164,369, Response filed Mar. 22, 2010.

* cited by examiner

LATCH MECHANISM

FIELD OF THE INVENTION

The present invention concerns vehicles, and more particularly relates to a double pull linkage mechanism for a door of a vehicle.

BACKGROUND OF THE INVENTION

Heretofore, as is known in the art, vehicle door latch assemblies generally include a latch mechanism operable by means of inner and outer door handles. Such latch assemblies can vary in design based on a variety of factors such as the type of vehicle (e.g., car, minivan, truck, etc.), as well as the location of the latch assembly on the specific vehicle. For example, a latch assembly located on a front door of a vehicle may be operable in a single or double pull mode of an inside handle, whereas a latch assembly located on a rear door may require additional child-lock related operability (e.g., no latch over-ride). In Europe, however, the same vehicle may include a rear door latch over-ride. Thus, for a single car, four unique latch assemblies (front/rear, left/right) may be required, with each latch assembly including uniquely designed mechanical features. Moreover, the same vehicle may include yet further latch operation variations when sold in different countries.

For automobiles produced by the millions, reduction of any such variations can result in significant cost savings from design, manufacturing and servicing perspectives. Yet further, streamlining of such functions in one or more latch assemblies can further provide greater flexibility in the ability to customize such functions, and thus greater customer satisfaction.

SUMMARY OF THE PRESENT INVENTION

An aspect of the present invention is to provide a latch system for a door of a vehicle comprising a latch assembly, an actuatable inside handle, a linkage assembly and an actuator. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The linkage assembly is mechanically linked between the inside handle and the latch assembly. The actuator is interconnected to the pawl. The actuator is configured to be activated by actuation of the inside handle. The catch is configured to be moved to the open position after actuation of the inside handle by activating the actuator to thereby move the pawl to stop the pawl from maintaining the catch in the closed position when the vehicle has power. The catch is also configured to be moved to the open position after actuation of the inside handle by having the inside handle mechanically move the linkage assembly to stop the pawl from maintaining the catch in the closed position when the vehicle has power. The catch is configured to be moved to the open position after actuation of the inside handle by having the inside handle mechanically move the linkage assembly to stop the pawl from maintaining the catch in the closed position when the vehicle does not have power.

Another aspect of the present invention is to provide a latch system for a door of a vehicle comprising a latch assembly, an inside handle, a linkage assembly and an actuator. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The latch assembly has a locked condition wherein the pawl is prevented from releasing the catch. The inside handle is configured to actuate the pawl to stop the pawl from maintaining the catch in the closed position to thereby allow the door to move to the open location. The linkage assembly is mechanically linked between the inside handle and the latch assembly whereby the inside handle can be used to move the pawl. The actuator is interconnected to the pawl. The actuator is configured to be activated by actuation of the inside handle. If the latch assembly is in the locked condition, the actuator prevents actuation of the inside handle from actuating the pawl to stop the pawl from maintaining the catch in the closed position until the vehicle does not have power.

Yet another aspect of the present invention is to provide a method of controlling a location of a door of a vehicle comprising providing a latch assembly including a catch and a pawl, with the catch having a closed position wherein the catch is configured to grasp a portion of the vehicle to maintain the door in a closed location and an open position wherein the catch is configured to release the portion of the vehicle to allow the door to move to an open location. The method also includes providing an actuatable inside handle, mechanically linking a linkage assembly between the inside handle and the latch assembly, and interconnecting an actuator with the pawl. When the vehicle has power, the method includes allowing the door to move to the open location by actuating the inside handle to activate the actuator to move the linkage assembly to thereby stop the pawl from maintaining the catch in the closed position. Additionally, when the vehicle has power, the method includes allowing the door to move to the open location by actuating the inside handle to directly mechanically move the linkage assembly to thereby stop the pawl from maintaining the catch in the closed position. When the vehicle does not have power, the method includes allowing the door to move to the open location by actuating the inside handle to directly mechanically move the linkage assembly to thereby stop the pawl from maintaining the catch in the closed position.

Another aspect of the present invention is to provide a method of controlling a location of a door of a vehicle comprising providing a latch assembly including a catch and a pawl, with the catch having a closed position wherein the catch is configured to grasp a portion of the vehicle to maintain the door in a closed location and an open position wherein the catch is configured to release the portion of the vehicle to allow the door to move to an open location. The latch assembly has a locked condition wherein the pawl is prevented from releasing the catch. The method also includes providing an inside handle configured to actuate the pawl to stop the pawl from maintaining the catch in the closed position to thereby allow the door to move to the open location, mechanically linking a linkage assembly between the inside handle and the latch assembly whereby the inside handle can be used to move the pawl, interconnecting an actuator with the pawl, providing the latch assembly with a locked condition wherein the pawl is prevented from releasing the catch, and preventing actuation of the inside handle from actuating the pawl to stop the pawl from maintaining the catch in the closed position with the actuator until the vehicle does not have power if the latch assembly is in the locked condition.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
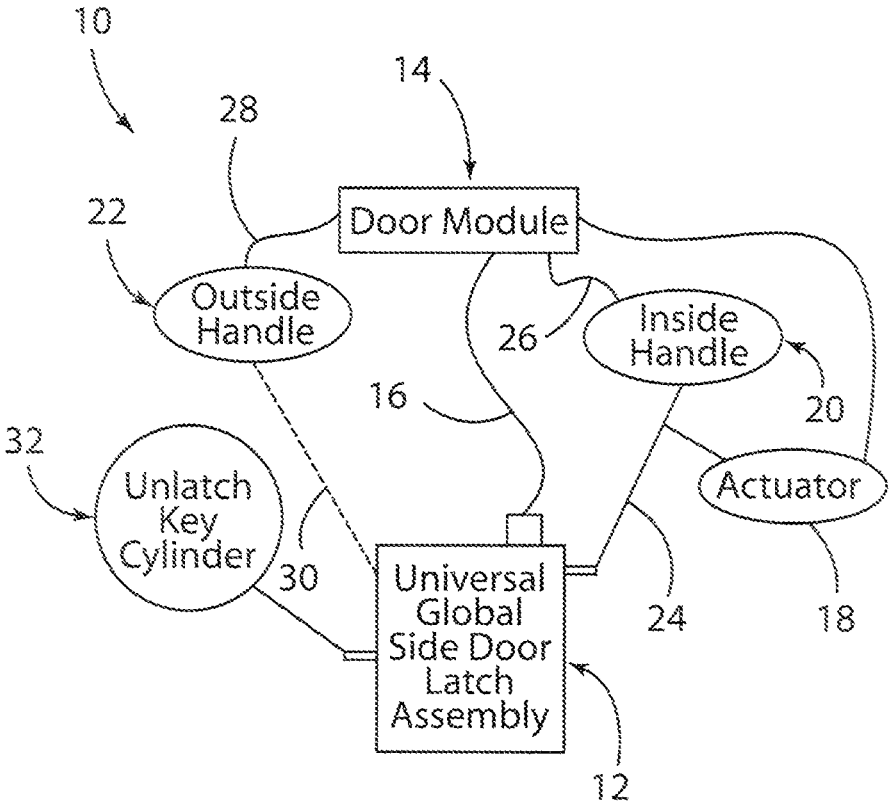
FIG. 1 is a schematic view of a latch system of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a latch system of the present invention. The latch system 10 can be used in any vehicle having doors and includes a latch assembly 12 for each door, with each latch assembly 12 being configured to keep their associated door closed or to allow their associated door to open. In a preferred embodiment, all of the latch assemblies 12 in the vehicle are substantially identical. However, it is contemplated that not all of the latch assemblies 12 need to be substantially identical (e.g., the front doors can have different latch assemblies 12 than the rear doors or all doors can have different latch assemblies 12).

In the illustrated example, the latch system 10 can be used in a vehicle having a centralized control system for controlling the latch assemblies 12 for all doors of the vehicle or a control system for controlling the latch assembly 12 for a single door. The centralized control system can be used to open a door, to keep the door closed or to provide certain functionality to the latch assembly (for example, locking, unlocking, child-locking, double locking, etc.) for a particular door or for each latch assembly 12. Accordingly, the structure of the latch assemblies 12 for each of the doors can be structurally identical, with the centralized control system individually and selectively altering the functionality for each door. As illustrated in FIG. 1, a door module 14 represents the control system for the latch assembly 12. The door module 14 can be connected to one latch assembly 12 for one door (as shown) or can be connected to multiple latch assemblies 12 for multiple doors. The door module 14 can include a microprocessor and a memory unit and communicates with the latch assembly 12 via an electrical control line 16 (either wired or wireless). For example, the electrical control line 16 can include a single-control bus with a return through a common chassis ground.

In the illustrated embodiment, each of the latch assemblies 12 can be associated with a respective control and driver circuit including a microprocessor which is, in turn, associated with an actuator 18 as discussed in more detail below. The actuator 18 may be connected to the driver circuit through a bistable relay. The circuits can include or can be programmed to be demultiplexers for receiving serial control signals transmitted over the electrical control line 16 and for converting them to control signals for the actuator 18. Correspondingly, the door module 14 can have its microprocessor programmed to constitute a multiplexer or can include a separate multiplexer. While the system as thus far described uses unidirectional information or control signal flow, a bidirectional signal transmission is also possible. For example, the processors of the circuits can dialogue with the door module 14 and can transmit signals indicating the state of the respective latch assembly 12 to the door module 14. Each of the processors of the control and driver circuits can be provided with a lock identity code word storage or memory. Correspondingly, the door module 14 can have a memory for storage connected to its central processor and serving as control system identity code word storage. Each of the identity code word memories or storage has a respective identity code word stored therein and can output this code word upon interrogation so that the code words can be compared with one another. Upon a failure of agreement between interrogated identity code words, the latch assemblies 12 are automatically brought into the "antitheft securing mode on" and "child-safety mode on" positions and deactivated to prevent opening of the door. Alternatively or simultaneously, the door module 14 can be deactivated.

The illustrated latch system 10 as illustrated in FIG. 1 includes the latch assembly 12 connected to the door module 14 via the electrical control line 16 as discussed above. The latch assembly 12 also includes an inside handle 20 located within an interior of the vehicle and an outside handle 22 located at an exterior of the vehicle. The inside handle 20 is mechanically connected to the latch assembly 12 via a linkage assembly 24 as discussed in more detail below. The inside handle 20 can also electrically communicate with the door module 14 via an inside handle electrical control line 26 (either wired or wireless). In the illustrated embodiment, the outside handle 22 electrically communicates with the door module 14 via an outside handle electrical control line 28 (either wired or wireless). However, it is contemplated that the outside handle 22 could be mechanically connected to latch assembly 12 via a mechanical linkage (shown as dashed line 30 in FIG. 1) in an manner typically used and known to those skilled in the art (with a powered or mechanically actuated lock). As discussed in more detail below, the latch system 10 can also include an unlatch key cylinder 32 mechanically connected to the latch assembly 12 for allowing the latch assembly 12 to allow its associated door to open from an exterior of the vehicle. It is contemplated that only the driver side door, the front doors or all the doors could include the unlatch key cylinder 32.

Figure 2:
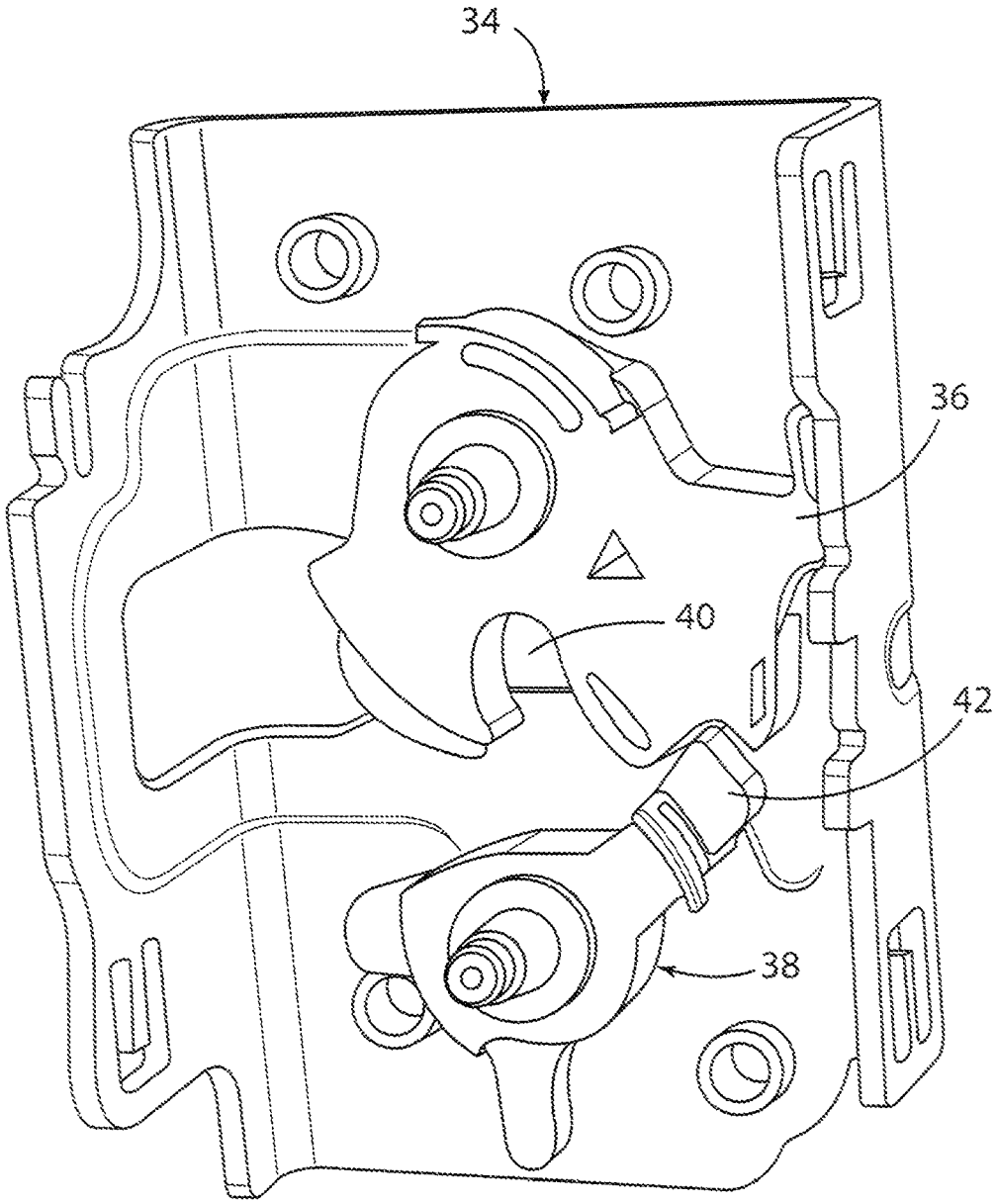
FIG. 2 is a partial perspective view of a typical latch for a door.

In the illustrated example, the latch assembly 12 (FIG. 2) is configured to maintain the door in a closed location and to allow the door to move to an open location. The latch assembly 12 includes a latch housing 34 having a catch 36 and a pawl 38. As is well known to those skilled in the art, the catch 36 includes a slot 40 configured to selectively accept a post (not shown) of a vehicle frame to maintain the door in the closed location. FIG. 2 illustrates the catch 36 in a closed position wherein the post of the vehicle would be trapped within the slot 40 such that the door is maintained in the closed location. The pawl 38 is configured to maintain the catch 36 in the closed position by having an extension 42 of the pawl 38 abut against the catch 36 to prevent rotation of the catch 36. The pawl 38 is configured to rotate clockwise as shown in FIG. 2 to allow the catch 36 to rotate. Once the pawl 38 moves out of engagement with the catch 36, the catch 36 is configured to rotate clockwise as shown in FIG. 2 to an open position to release the post of the vehicle frame, thereby allowing the door to move to an open location. The structure and function of the catch 36 and the pawl 38 as discussed directly above are well known to those skilled in the art. An aspect of the present invention is to include a linkage assembly 44 (see FIGS. 3-9) and to have the linkage assembly 44 interact with the latch assembly 12.

Figure 3:
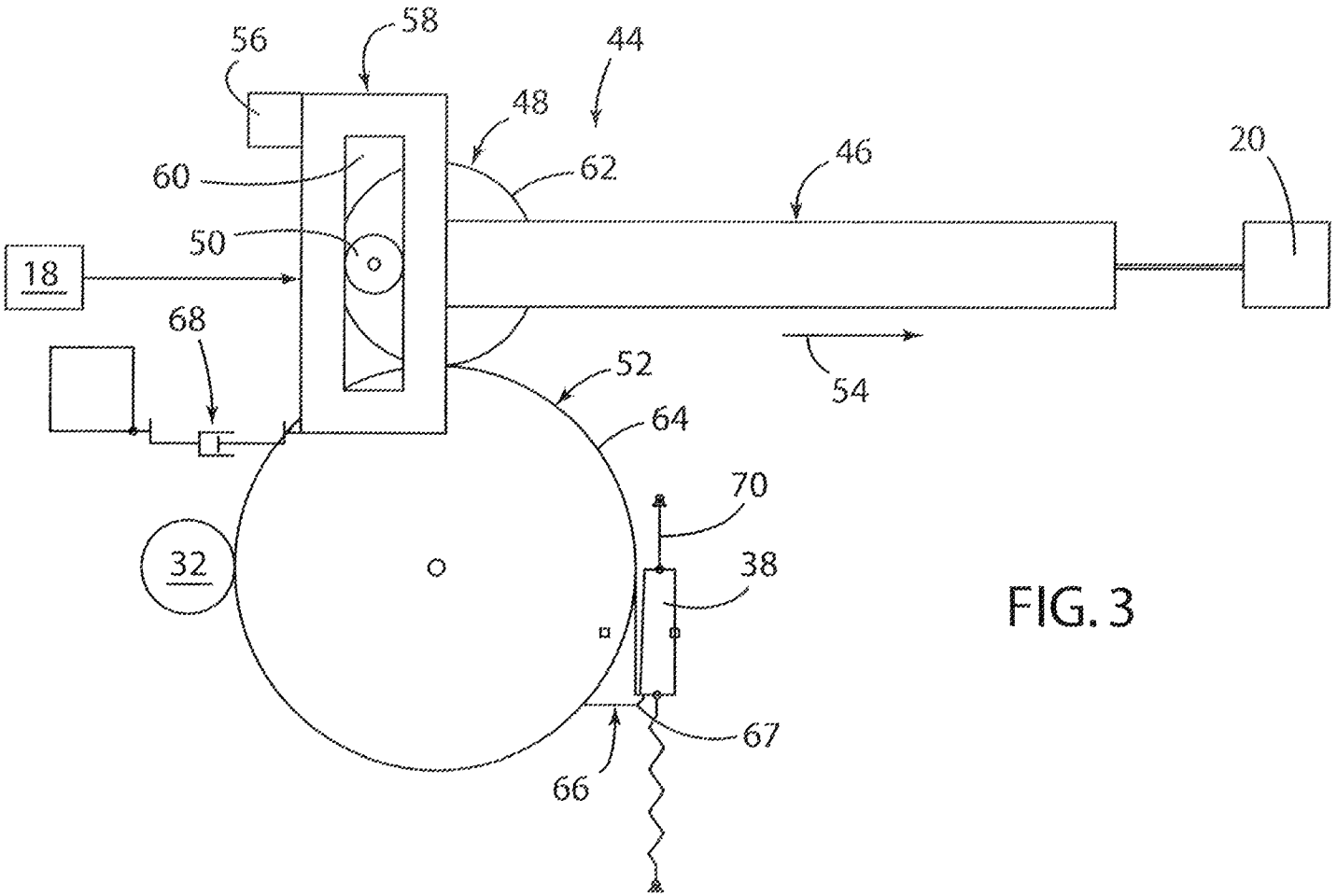
FIG. 3 is a schematic view of the present invention showing a linkage mechanism of the present invention in an initial position.

The illustrated linkage assembly 44 (FIGS. 3-9) is mechanically linked between the inside handle 20 and the latch assembly 12. The linkage assembly 44 includes an inside release lever 46, a first gear 48 having a gear post 50 and a second gear 52. The inside release lever 46 is connected to the inside handle 20. When the inside handle 20 is actuated (e.g., pulled), the inside release lever 46 is configured to move linearly along line 54 as illustrated in FIG. 3. As discussed in association with FIGS. 3-9, movement of the inside release handle 46 causes the first gear 48 and the second gear 52 to rotate.

In the illustrated example, FIG. 3 illustrates the linkage assembly 44 in an initial position. In the initial position, the inside release lever 46 is at an initial position and abuts a fixed anchor 56 in the vehicle. The inside release lever 46 includes a head 58 having a rectangular opening 60 therein. The gear post 50 of the first gear 48 is located within the rectangular opening 60 of the head 58 of the inside release lever 46. In the initial position, the gear post 50 is located at nine o'clock on the first gear 48. The first gear 48 includes first gear teeth 62 engaged with second gear teeth 64 on the second gear 52 such that rotation of the first gear 48 causes the second gear 52 to rotate and rotation of the second gear 52 causes the first gear 48 to rotate. The second gear 52 includes a pawl actuation member 66 configured to engage the pawl 38. FIGS. 3-9 include a cross-section of the pawl 38 in a direction substantially perpendicular to the pawl 38 as illustrated in FIG. 2 such that vertical motion of a portion of the pawl 38 in FIGS. 3-9 will translate to rotational movement of the pawl 38 when viewed from the front as in FIG. 2. The pawl actuation member 66 includes a prong 67 abutting the pawl 38 and preventing the pawl 38 from rotating (and thereby preventing the catch 36 from moving to the open position and the door from moving to the open location).

Figure 4:
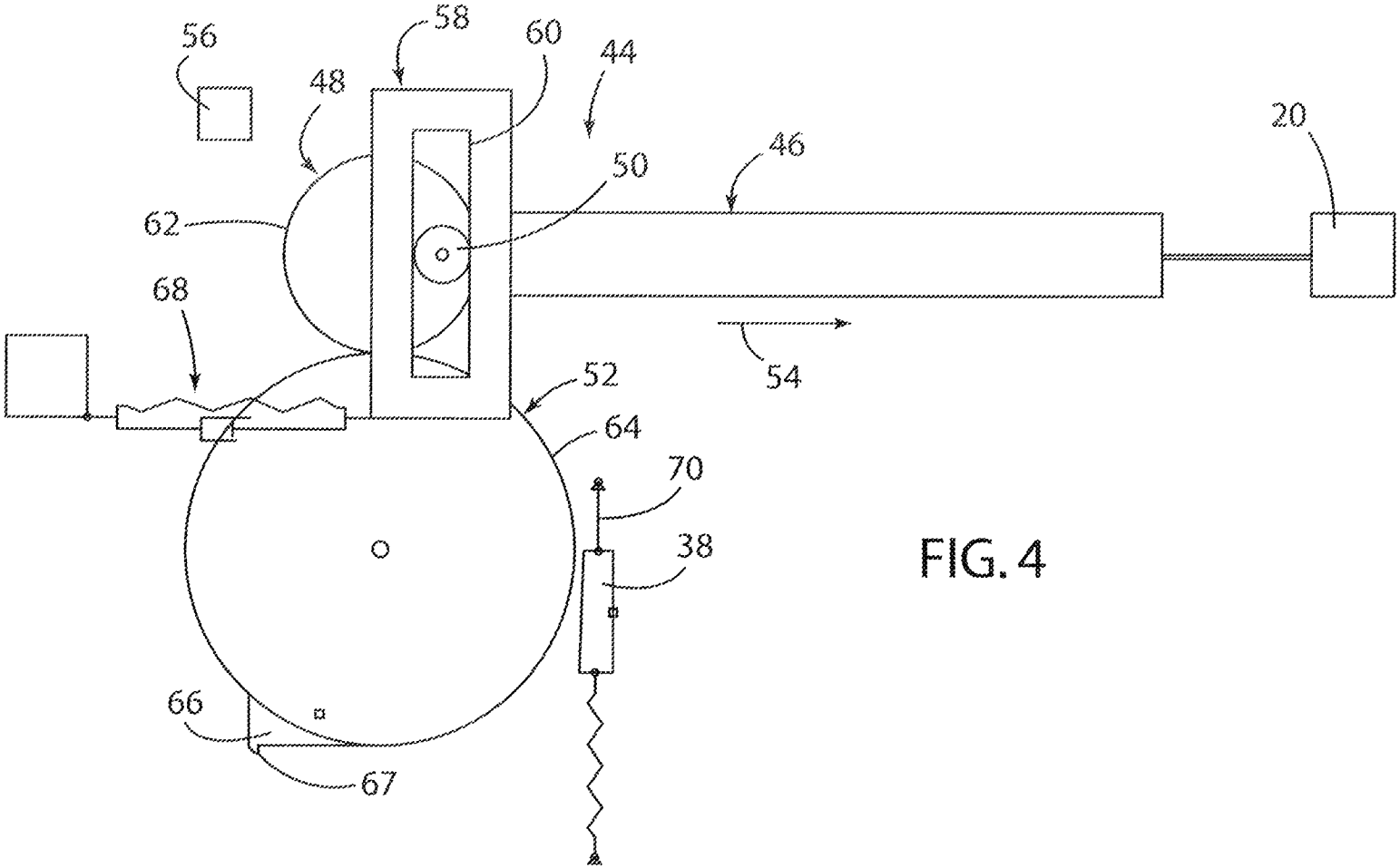
FIG. 4 is a schematic view of the present invention showing the linkage mechanism of the present invention in a first pulled position.

FIG. 4 illustrates the linkage assembly 44 after a first full actuation of the inside handle 20. Actuation of the inside handle 20 causes the inside release lever 46 to move along line 54 against the force of a spring damper 68. As the inside release lever 46 is moved along line 54, the gear post 50 will move first downward and then upward within the rectangular opening 60 of the head 58 of the inside release lever 46, thereby causing the first gear 48 to rotate counter-clockwise approximately 180°. Rotation of the first gear 48 will cause the second gear 52 to rotate. As illustrated in FIG. 4, the second gear 52 is larger than the first gear 48 such that 180° counter-clockwise rotation of the first gear 48 will cause the second gear 52 to rotate 90° clockwise. Furthermore, the pawl actuation member 66 will rotate with the second gear 52 such that the prong 67 on the pawl actuation member 66 no longer prevents the pawl 38 from rotating.

Figure 5:
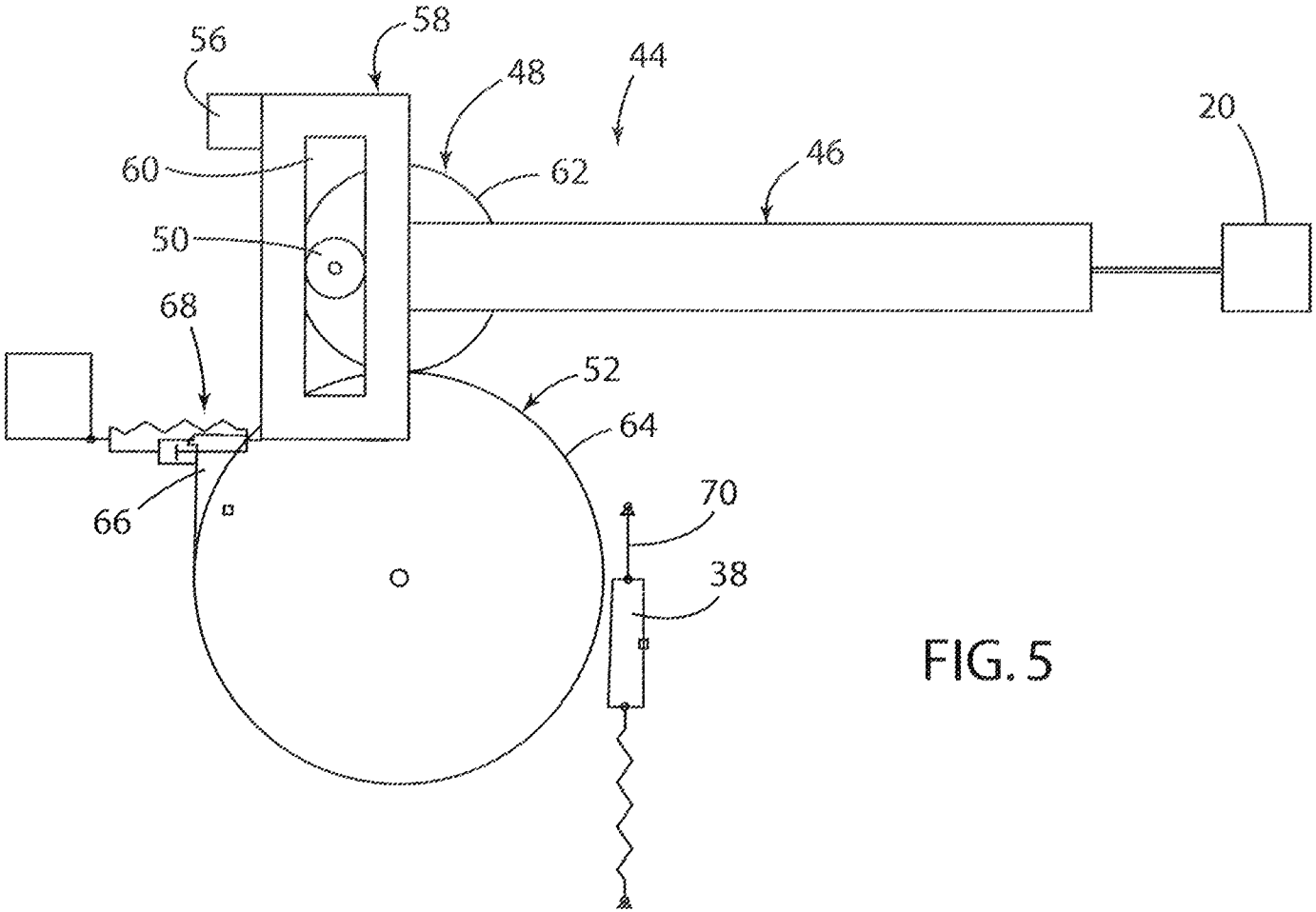
FIG. 5 is a schematic view of the present invention showing the linkage mechanism of the present invention in a first released position.

FIG. 5 illustrates the linkage assembly 44 after the inside handle 20 has been released after the first full actuation of the inside handle 20. After the inside handle 20 has been released after the first full actuation of the inside handle 20, the spring damper 68 pulls the inside release lever 46 in a direction opposite to line 54 and back to the initial position of the inside release lever 46. As the inside release lever 46 is moved back to its initial position, the gear post 50 will move first upward and then downward within the rectangular opening 60 of the head 58 of the inside release lever 46, thereby causing the first gear 48 to rotate counter-clockwise another approximately 180° (for a total of approximately 360° or one full rotation). Further rotation of the first gear 48 will cause the second gear 52 to further rotate. As illustrated in FIG. 5, the further 180° counter-clockwise rotation of the first gear 48 will cause the second gear 52 to rotate another 90° clockwise (for a total of 180° clockwise rotation). Furthermore, the pawl actuation member 66 is rotated with the second gear 52 another 90°.

Figure 6:
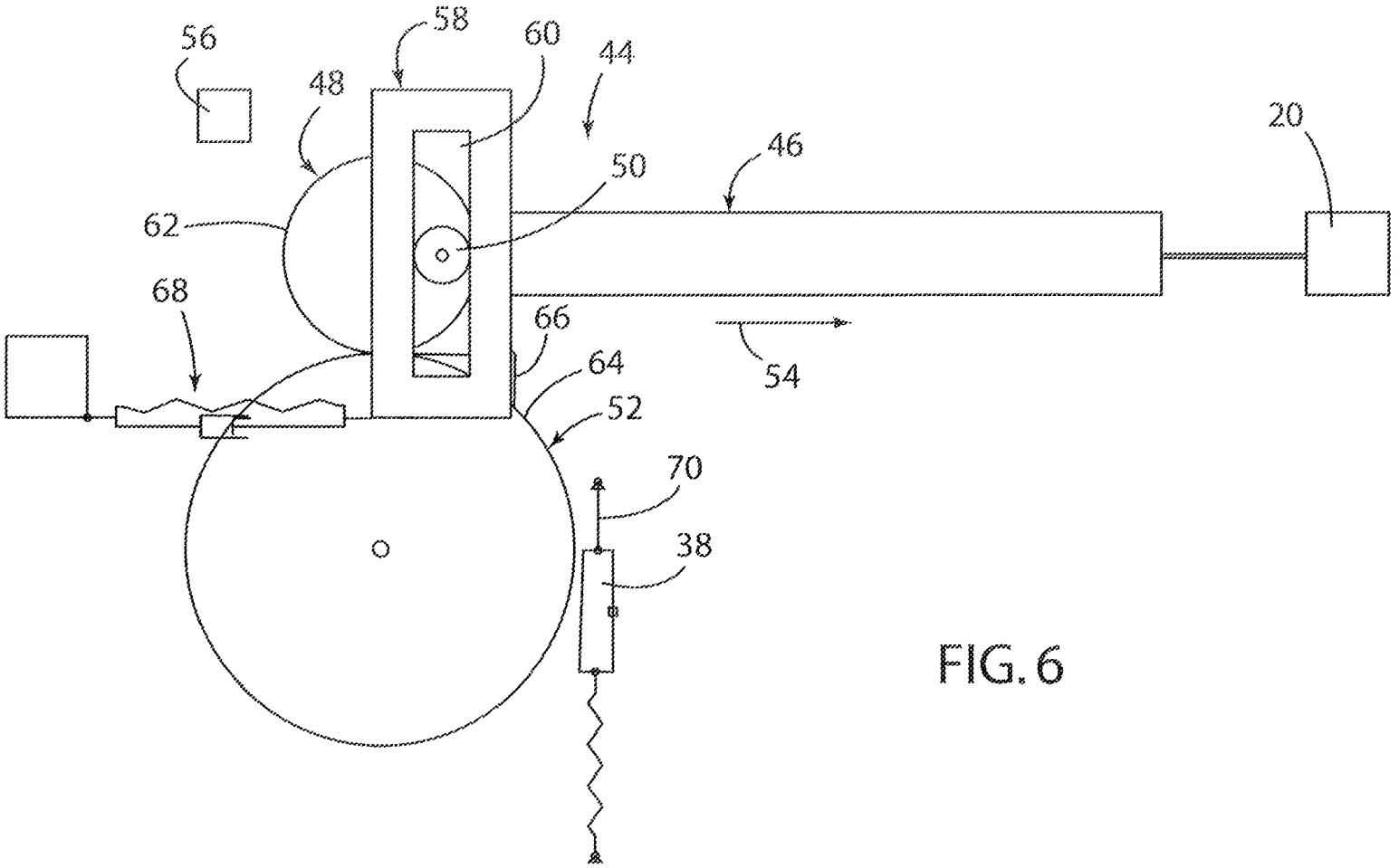
FIG. 6 is a schematic view of the present invention showing the linkage mechanism of the present invention in a second pulled position.

FIG. 6 illustrates the linkage assembly 44 after a second full actuation of the inside handle 20. As discussed above, actuation of the inside handle 20 causes the inside release lever 46 to move along line 54 against the force of a spring damper 68. As the inside release lever 46 is moved along line 54, the gear post 50 will move first downward and then upward within the rectangular opening 60 of the head 58 of the inside release lever 46, thereby causing the first gear 48 to rotate counter-clockwise another approximately 180°. This additional rotation of the first gear 48 will cause the second gear 52 to further rotate. As illustrated in FIG. 6, the further 180° counter-clockwise rotation of the first gear 48 will cause the second gear 52 to rotate another 90° clockwise (for a total of 270° clockwise rotation). Furthermore, the pawl actuation member 66 is rotated with the second gear 52 another 90°.

Figure 7:
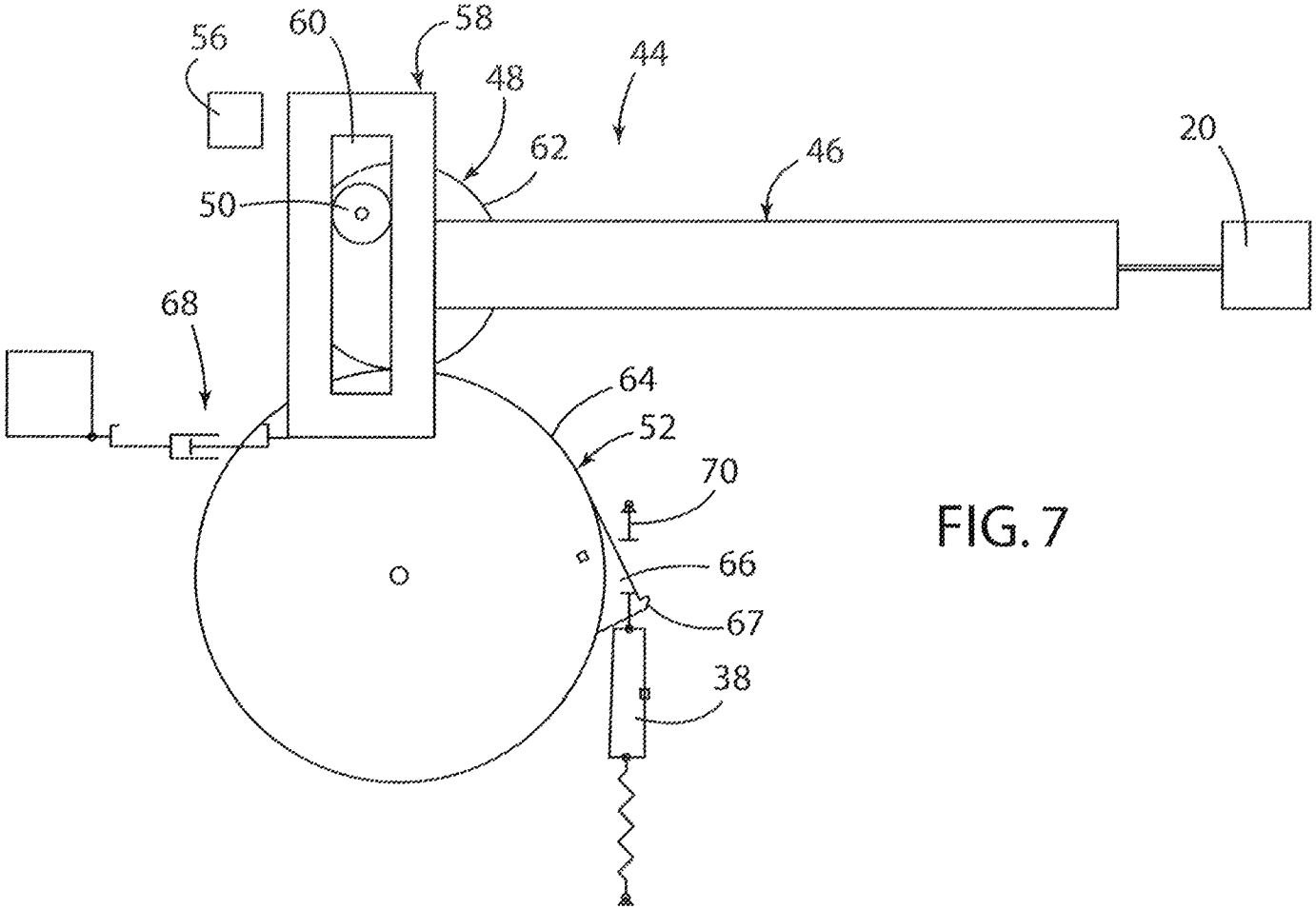
FIG. 7 is a schematic view of the present invention showing the linkage mechanism of the present invention in a second released position beginning actuation of a pawl actuation member.

FIG. 7 illustrates the linkage assembly 44 in a first released position after the inside handle 20 has been released after the second full actuation of the inside handle 20. After the inside handle 20 has been released after the second full actuation of the inside handle 20, the spring damper 68 pulls the inside release lever 46 in a direction opposite to line 54 and back to the initial position of the inside release lever 46. As the inside release lever 46 is moved back to its initial position, the gear post 50 will move first upward and then downward within the rectangular opening 60 of the head 58 of the inside release lever 46, thereby causing the first gear 48 to rotate counter-clockwise another approximately 180° (for a total of approximately 720° or two full rotations). Further rotation of the first gear 48 will cause the second gear 52 to further rotate. As illustrated in FIG. 7, as the spring damper 68 pulls the inside release lever in a direction opposite to line 54 and back to the initial position of the inside release lever 46, thereby causing the first gear 48 and the second gear 52 to rotate, the pawl actuation member 66 abuts a top of the pawl 38 to thereby move the pawl 38 against the force of a pawl spring 70. Such movement of the pawl 38 releases the catch 36 as discussed above to allow the catch 36 to move to the open position and to allow the door to move to the open location.

Figure 8:
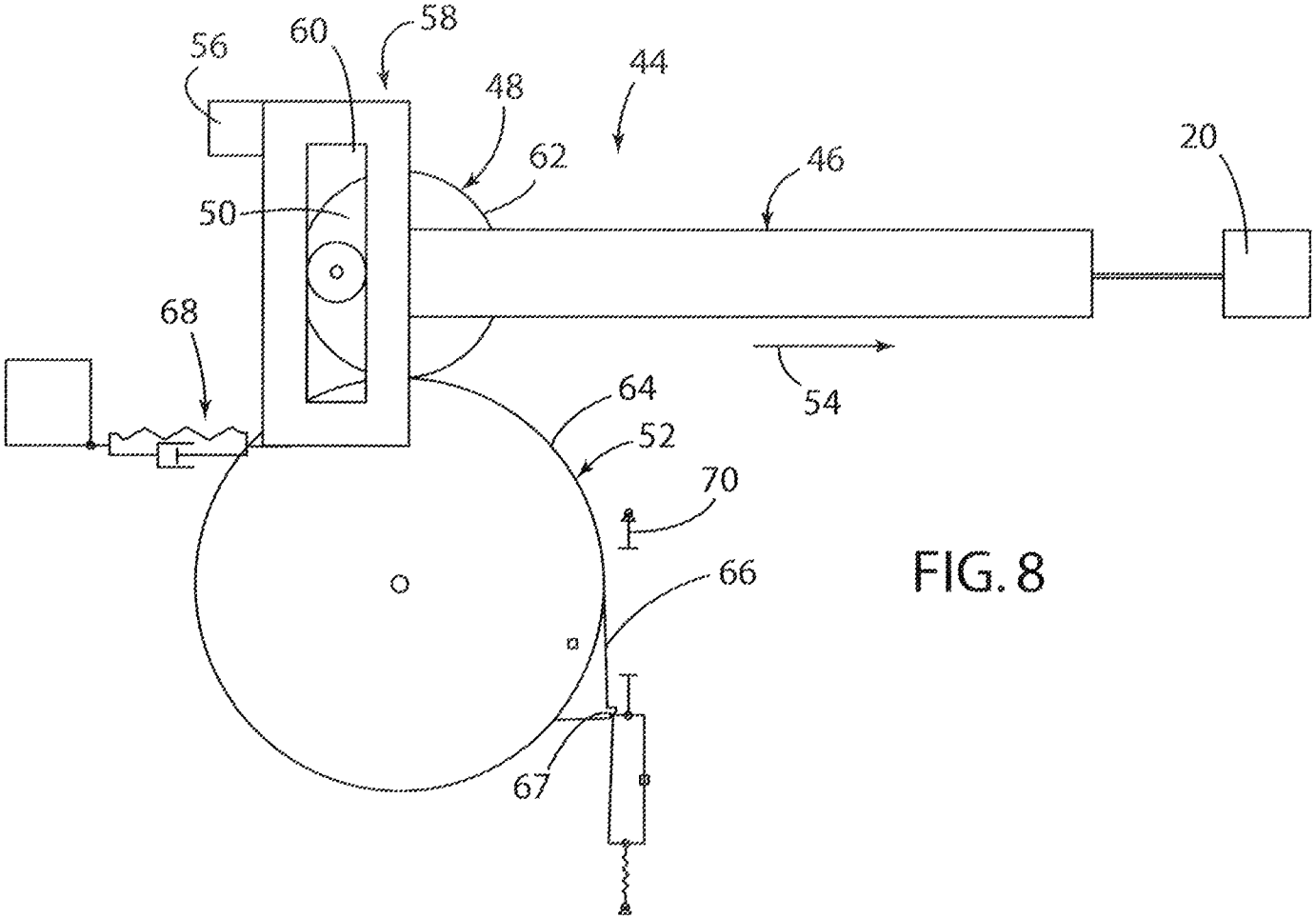
FIG. 8 is a schematic view of the present invention showing the linkage mechanism of the present invention in the second released position ending actuation of the pawl actuation member.
Figure 9:
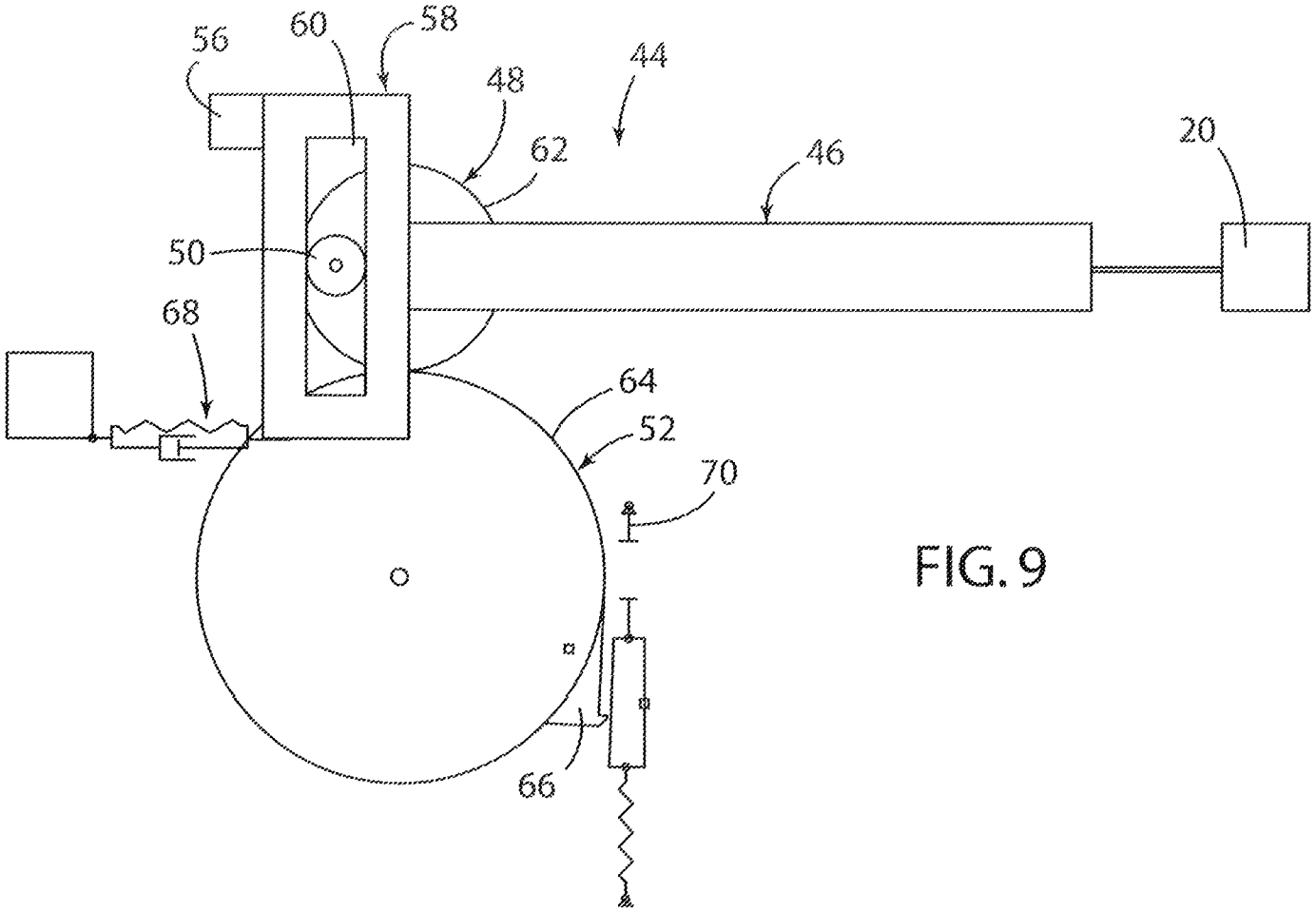
FIG. 9 is a schematic view of the present invention showing the linkage mechanism of the present invention in the second released position moving towards the initial position of FIG. 3.

FIG. 8 illustrates further movement of the inside release lever 46 back to the initial position, further rotation of the first gear 48 and the second gear 52, and further movement of the pawl 38 by movement of the pawl actuation member 66. FIG. 9 illustrates the linkage assembly 44 back in the initial position right before that shown in FIG. 3 and after the pawl actuation member 66 has passed by the pawl 38, thereby allowing the pawl 38 to go back to its initial position in FIG. 3.

Accordingly, the linkage assembly 44 allows a person inside the vehicle to open the door by pulling the inside handle 20 twice such that the pawl actuation member 66 forces the pawl 38 to move, thereby allowing the pawl 38 to release the catch 36 as discussed above to allow the catch 36 to move to the open position and to allow the door to move to the open location. Therefore, the latch system 10 can be configured to allow the latch assembly 12 to allow the door to open with every second pull of the inside handle 20.

It is also contemplated that the illustrated latch system 10 can have the actuator 18 mechanically engaged with the linkage assembly 44 and configured to move at least a portion of the linkage assembly 44. For example, the actuator 18 can comprise a linear actuator configured to move the inside release lever 46 along line 54, an actuator configured to move the gear post 50 of the first gear 48, an actuator configured to rotate the first gear 48 (e.g., a linear actuator having a rack engaged with the first gear teeth 62 of the first gear 48), or an actuator configured to rotate the second gear 52 (e.g., a linear actuator having a rack engaged with the second gear teeth 64 of the second gear 52). FIG. 3 includes one of the above example, with the actuator 18 engaged with the inside release lever 46 (it being understood that the actuator 18 could be engaged with the inside release lever 46 in FIGS. 4-9 or with any other portion of the linkage assembly 44). Therefore, the actuator 18 can be activated to open the door by moving the pawl 38 via movement of the pawl actuation member 66 by moving the inside release lever 46, the gear post 50 of the first gear 48, the first gear 48, or the second gear 52. Accordingly, the catch 36 would move to the open position, thereby allowing the door to move to the open location. The actuator 18 can also be employed to prevent the pawl 38 from moving by maintaining the pawl actuation member 66 in its initial position or moving the pawl actuation member 66 to its initial position as illustrated in FIG. 3 such that the prong 67 abuts the pawl 38 and prevents the pawl 38 from rotating. It is also contemplated that the actuator 18 could be integrated into the latch assembly 12 such that activation of the actuator 18 directly moves the pawl 38 or directly prevents the pawl 38 from moving.

The illustrated actuator 18 can be activated by a signal from the door module 14. For example, the actuator 18 can be activated to open the door by actuation of the inside handle 20 or the outside handle 22. It is also contemplated that the door module 14 could receive a remote signal such that the door automatically opens (for example, with a button on a key chain wirelessly sending a signal to the door module 14 telling the door module 14 to open the door). The actuator 18 can also be used to prevent the door from moving to the open location (e.g., when the door module 14 is set in a child-lock state) by continuously moving the pawl activation member 66 back to its initial position to prevent the pawl 38 from rotating. It is noted that the actuator 18 only works when the vehicle has power (or when the actuator 18 is powered). Therefore, when the vehicle (or actuator 18) does not have power, the door can only be moved to the open location from the inside by pulling the inside handle 20 twice. It is also noted that the inside release lever 46 is configured to move relative to the inside handle 20 such that the actuator 18 can move the inside release lever 46 as discussed above without moving the inside handle 20 (for example, the connection between the inside release lever 46 and the inside handle 20 could only be a tension connection such that compression of the connection will not move both of these parts).

In the illustrated example, the unlatch key cylinder 32 functions similar to the actuator 18. The unlatch key cylinder 32 allows a person outside the vehicle to open the door. The unlatch key cylinder 32 is mechanically engaged with the linkage assembly 44. The unlatch key cylinder 32 is configured to accept a key of a user of the vehicle. The unlatch key cylinder 32 can comprise a typical cylinder lock. The unlatch key cylinder 32 is configured to move the linkage assembly 44 in the same manner the actuator 18 moves the linkage assembly 44. For example, the unlatch key cylinder 32 can move the inside release lever 46 along line 54, move the gear post 50 of the first gear 48, rotate the first gear 48 (e.g., by moving a rack engaged with the first gear teeth 62 of the first gear 48 or by direct engagement), or rotate the second gear 52 (e.g., by moving a rack engaged with the second gear teeth 64 of the second gear 52 or by direct engagement). FIG. 3 includes one of the above example, with the unlatch key cylinder 32 being engaged with the second gear 32 (it being understood that the unlatch key cylinder 32 could be engaged with the second gear 32 in FIGS. 4-9 or with any other portion of the linkage assembly 44). Therefore, the unlatch key cylinder 32 can be used to open the door by moving the pawl 38 via movement of the pawl actuation member 66 by moving the inside release lever 46, the gear post 50 of the first gear 48, the first gear 48, or the second gear 52. Accordingly, the catch 36 would move to the open position, thereby allowing the door to move to the open location.

Referring next to FIGS. 10-13, flowcharts of a vehicle front/rear door inside/outside release operation are provided.

Figure 10:
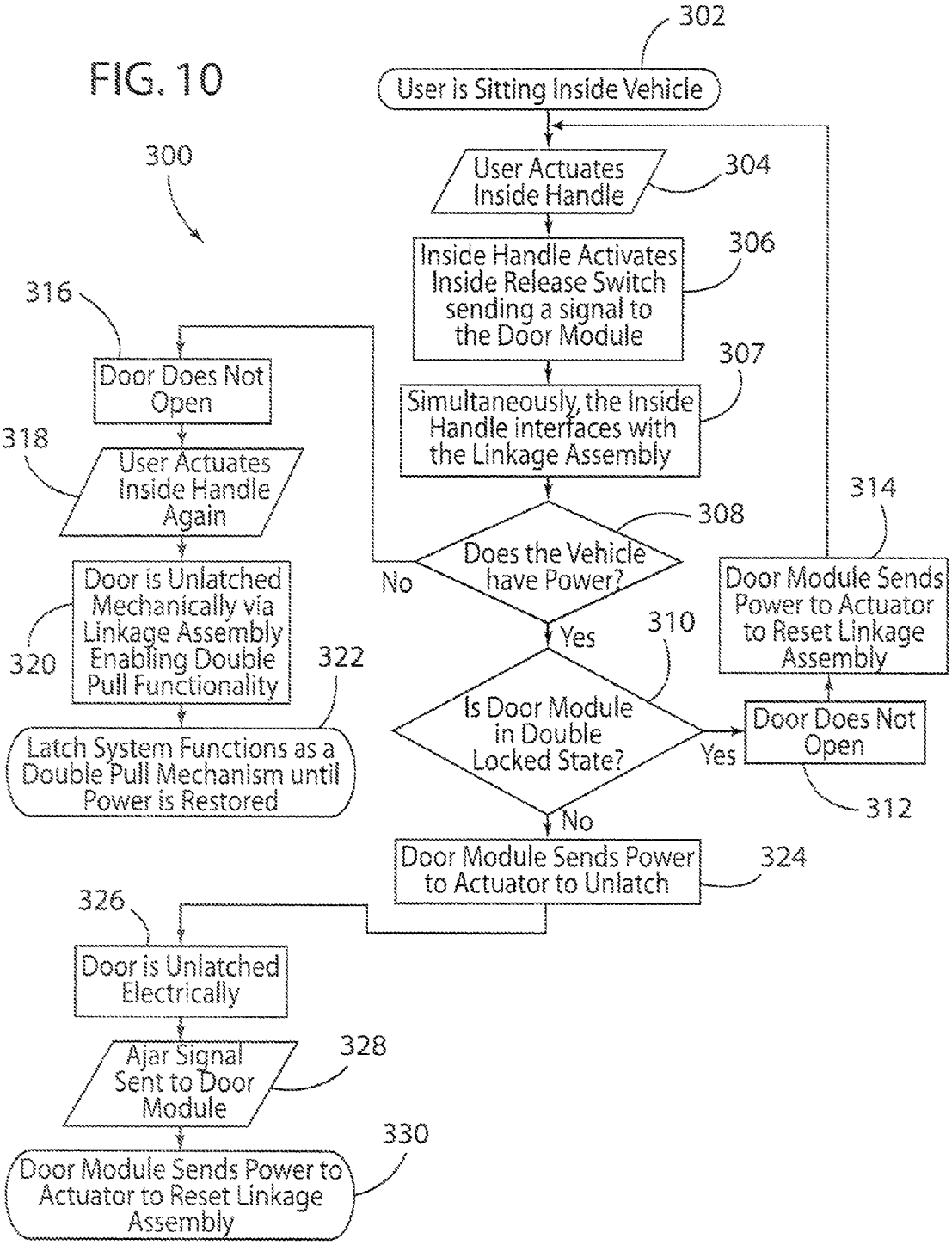
FIG. 10 is a flow chart illustrating a front door inside release operation.

Specifically, referring to FIG. 10, a front door inside release operation 300 will be described in detail. For front door inside release operation 300, at step 302, a user is seated inside the vehicle, and at step 304, the user actuates the inside handle 20. At step 306, when the user actuates the inside handle 20, an inside release switch is activated, thus sending a signal to the door module 14. Simultaneously, the inside handle 20 interfaces with the linkage assembly 44 at step 307. At step 308, if the vehicle has power, the method continues to step 310. At step 310, the door module 14 determines if the door module 14 is in a double locked state. If the determination at step 308 is yes, then at step 312, the vehicle door does not open. Thereafter, at step 314, the door module 14 sends a signal to the actuator 18 to reset the linkage assembly 44 moving the linkage assembly 44 to its initial position of FIG. 3 if it is not in its initial position. If the vehicle does not have power as determined at step 308, then at step 316, the vehicle door does not open until the user actuates the inside handle 20 again at step 318. Thereafter, at step 320, the door is unlatched mechanically via the linkage assembly 44 and the door is moved to the open location (thereby enabling a double pull functionality). Moreover, until the power is restored, the latch system 10 functions as a double pull mechanism at step 322. If the determination at step 310 is no (such that the door module 14 is not in a double locked state), the method 300 continues to step 324 where the door module 14 instructs the actuator 18 to move the linkage assembly 44 to allow the door to move to the open location at step 326 (by moving the pawl 38 as discussed above). Thereafter, at step 328, a signal is sent to the door module 14 telling the door module 14 that the door is ajar (or in the open location) such that the door module 14 can send a signal to the actuator 18 at step 330 to reset the linkage assembly 44 by moving the linkage assembly 44 to its initial position of FIG. 3 if it is not in its initial position. It is noted that if it is desired to have the door open only after every two pulls of the inside handle 20, the steps 324, 326, 328 and 330 can be replaced with steps 316, 318, 320 and 322, respectively.

Figure 11:
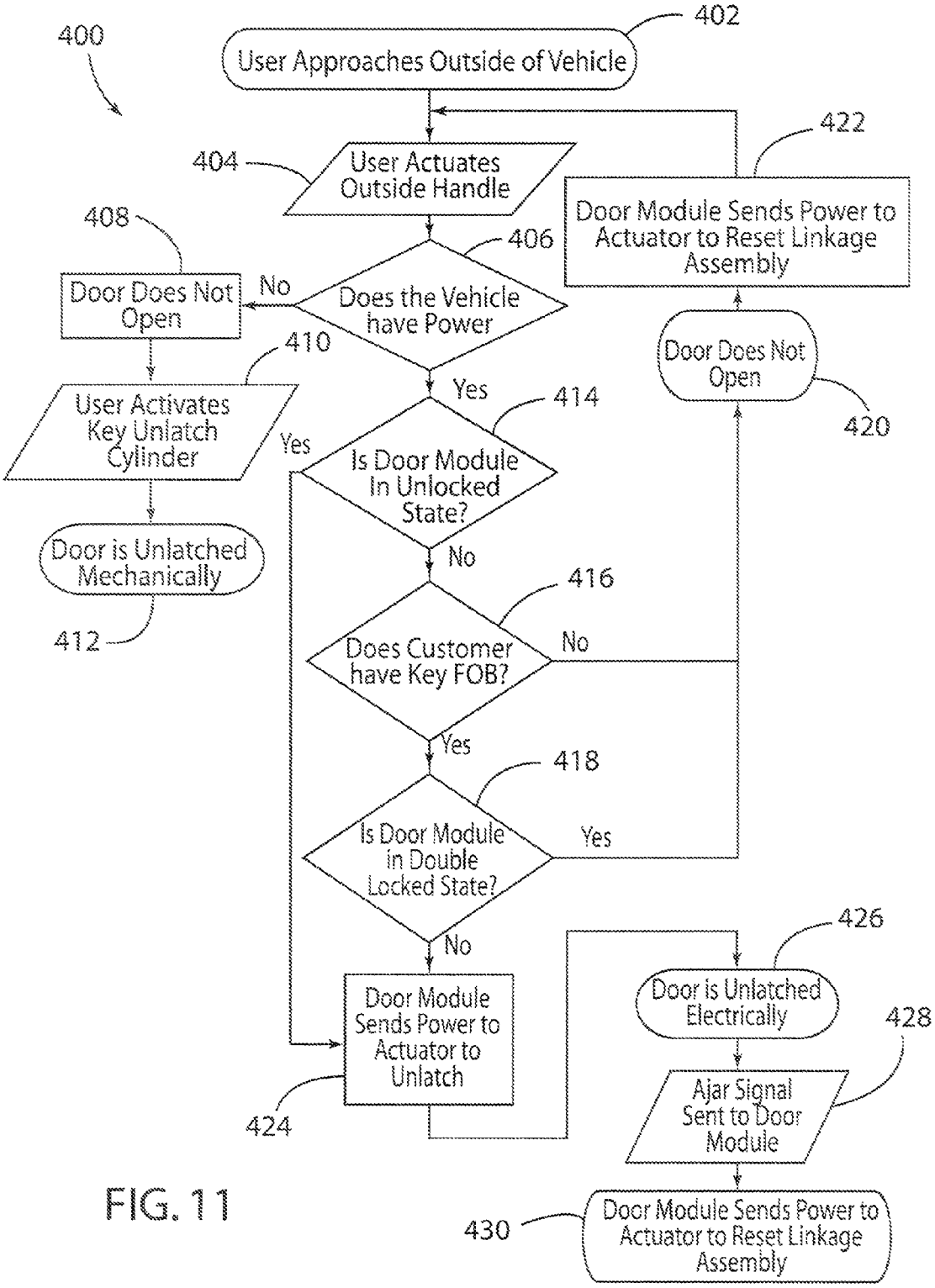
FIG. 11 is a flow chart illustrating a front door outside release operation.

Referring to FIG. 11, a front door outside release operation 400 will be described in detail. For front door outside release operation 400, at step 402, a user approaches an outside of the vehicle, and at step 404, the user actuates the outside handle 22. At step 406, if the vehicle has no power, the method continues to step 408. At step 408, the door does not open until the user actuates the key unlatch cylinder 32 at step 410 to mechanically move the door to the open location at step 412. If the vehicle does have power as determined at step 406, then at step 414, the door module 14 determines if the door module 14 is in an unlocked state. If the determination at step 414 is no, then at step 416, the door module 14 determines if the user has a key FOB for moving the door module 14 to the unlocked state. If the user does not have a key FOB at step 416, then at step 420, the vehicle door does not open. Thereafter, at step 422, the door module 14 sends a signal to the actuator 18 to reset the linkage assembly 44 by moving the linkage assembly 44 to its initial position of FIG. 3 if it is not in its initial position. If the user does have a key FOB at step 416, at step 418, the door module 14 determines if the door module 14 is a double locked state. If the door module 14 is in the double locked state, then at step 420, the vehicle door does not open and the actuator resets the linkage assembly 44 at step 422. If the determination at step 418 is no (such that the door module 14 is not in a double locked state) or if the determination at step 414 is yes (such that the door module 14 is in an unlocked state), the method 400 continues to step 424 where the door module 14 instructs the actuator 18 to move the linkage assembly 44 to allow the door to move to the open location at step 426 (by moving the pawl 38 as discussed above). Thereafter, at step 428, a signal is sent to the door module 14 telling the door module 14 that the door is ajar (or in the open location) such that the door module 14 can send a signal to the actuator 18 at step 430 to reset the linkage assembly 44 by moving the linkage assembly 44 to its initial position of FIG. 3 if it is not in its initial position.

Figure 12:
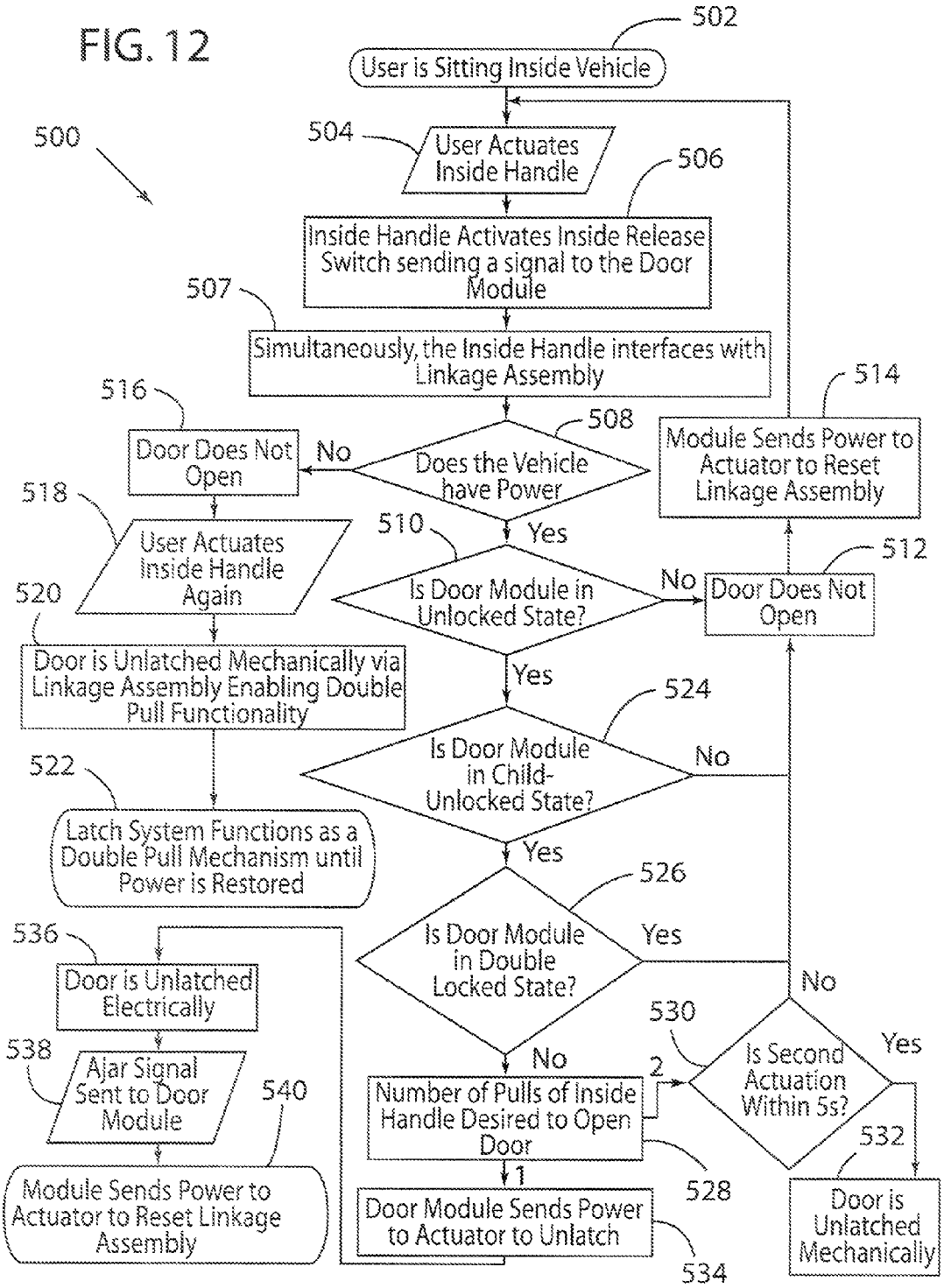
FIG. 12 is a flow chart illustrating a rear door inside release operation.

Referring to FIG. 12, a rear door inside release operation 500 will be described in detail. For rear door inside release operation 500, at step 502, a user is seated inside the vehicle, and at step 504, the user actuates the inside handle 20. At step 506, when the user actuates the inside handle 20, an inside release switch is activated, thus sending a signal to the door module 14. Simultaneously, the inside handle 20 interfaces with the linkage assembly 44 at step 507. At step 508, if the vehicle does not have power, the method continues to step 516. At step 516, the vehicle door does not open until the user actuates the inside handle 20 again at step 518. Thereafter, at step 520, the door is unlatched mechanically via the linkage assembly 44 and the door is moved to the open location (thereby enabling a double pull functionality). Moreover, until the power is restored, the latch system 10 functions as a double pull mechanism at step 522. If the vehicle does have power as determined at step 508, then at step 510, the door module 14 determines if the door module 14 is in an unlocked state. If the determination at step 510 is no, then at step 512, the vehicle door does not open. Thereafter, at step 514, the door module 14 sends a signal to the actuator 18 to reset the linkage assembly 44 by moving the linkage assembly 44 to its initial position of FIG. 3 if it is not in its initial position. If the door module 14 is in the unlocked state as determined at step 510, then at step 524, the door module 14 determines if the door module 14 is in a child-unlocked state. If the determination at step 524 is no, then at step 512, the vehicle door does not open and the actuator resets the linkage assembly 44 at step 514. If the door module 14 is in the child-unlocked state as determined at step 524, then at step 526, the door module 14 determines if the door module 14 is in a double locked state. If the determination at step 526 is yes, then at step 512, the vehicle door does not open and the actuator resets the linkage assembly 44 at step 514. If the determination at step 526 is no (such that the door module 14 is not in a double locked state), the method 500 continues to step 528 where the door module 14 determines the number of actuations of the inside handle 20 desired to open the door. If two actuations are desired as determined at step 528, then the door module 12 determines if the second actuation is within a certain time period (e.g., 5 seconds) at step 530. If the two actuations are within the certain time period, the door is unlatched mechanically (via the linkage assembly 44 as discussed above in regard to FIGS. 3-9) at step 532. However, if the two actuations are not within the certain time period, then at step 512, the vehicle door does not open and the actuator resets the linkage assembly 44 at step 514. If one actuation is desired as determined at step 528, the method 500 continues to step 534 where the door module 14 instructs the actuator 18 to move the linkage assembly 44 to allow the door to move to the open location at step 536 (by moving the pawl 38 as discussed above). Thereafter, at step 538, a signal is sent to the door module 14 telling the door module 14 that the door is ajar (or in the open location) such that the door module 14 can send a signal to the actuator 18 at step 540 to reset the linkage assembly 44 by moving the linkage assembly 44 to its initial position of FIG. 3 if it is not in its initial position.

Figure 13:
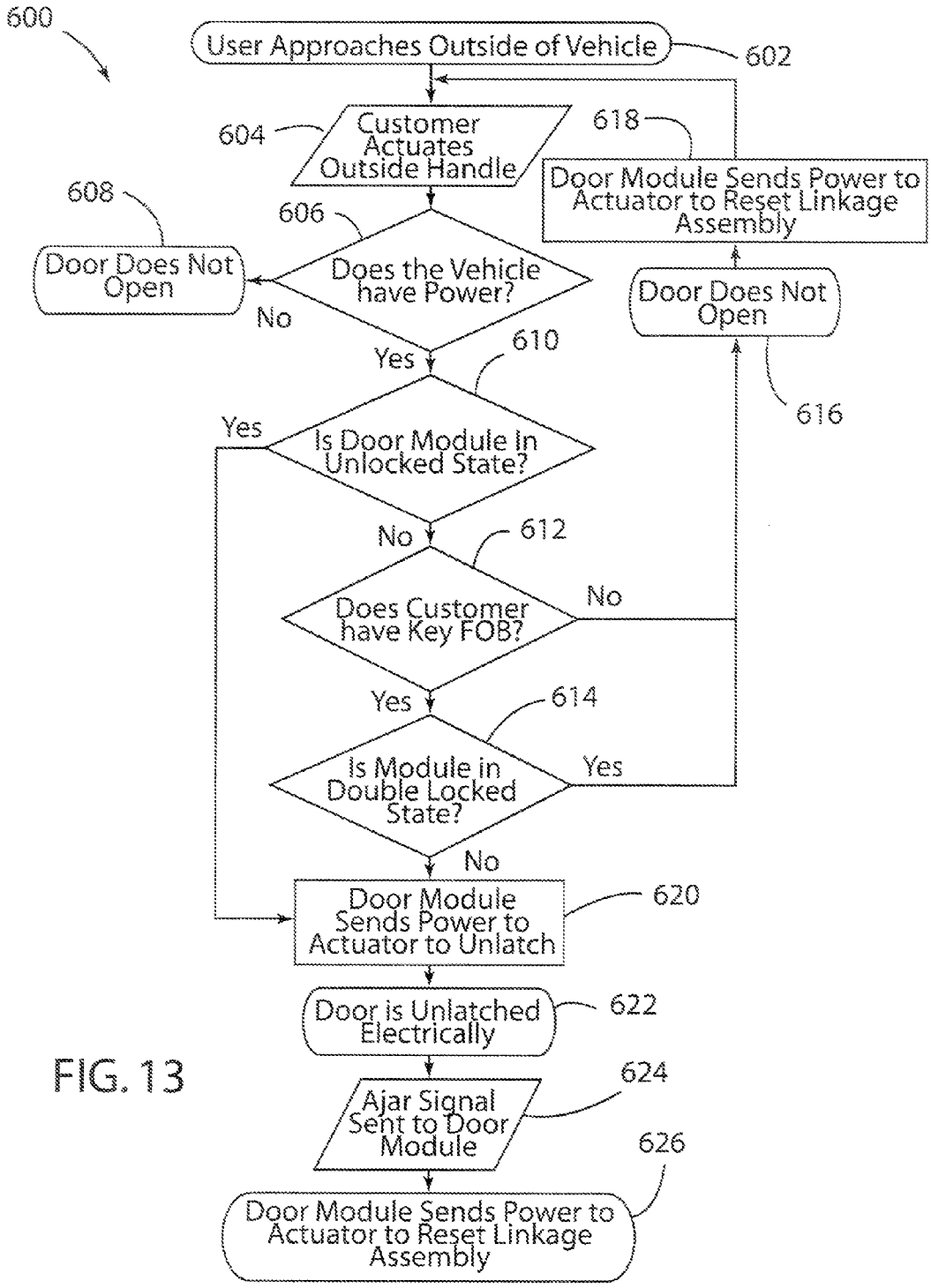
FIG. 13 is a flow chart illustrating a rear door outside release operation.

Referring to FIG. 13, a rear door outside release operation 600 will be described in detail. For rear door outside release operation 600, at step 602, a user approaches an outside of the vehicle, and at step 604, the user actuates the outside handle 22. At step 606, if the vehicle has no power, the method continues to step 608, where the door does not open. If the vehicle does have power as determined at step 606, then at step 610, the door module 14 determines if the door module 14 is an unlocked state. If the determination at step 610 is no, then at step 612, the door module 14 determines if the user has a key FOB for moving the door module 14 to the unlocked state. If the user does not have a key FOB at step 612, then at step 616, the vehicle door does not open. Thereafter, at step 618, the door module 14 sends a signal to the actuator 18 to reset the linkage assembly 44 by moving the linkage assembly 44 to its initial position of FIG. 3 if it is not in its initial position. If the user does have a key FOB at step 612, at step 614, the door module 14 determines if the door module 14 is in a double locked state. If the door module 14 is in the double locked state, then at step 616, the vehicle door does not open and the actuator resets the linkage assembly 44 at step 618. If the determination at step 614 is no (such that the door module 14 is not in a double locked state) or if the determination at step 610 is yes (such that the door module 14 is in an unlocked state), the method 600 continues to step 620 where the door module 14 instructs the actuator 18 to move the linkage assembly 44 to allow the door to move to the open location at step 622 (by moving the pawl 38 as discussed above). Thereafter, at step 624, a signal is sent to the door module 14 telling the door module 14 that the door is ajar (or in the open location) such that the door module 14 can send a signal to the actuator 18 at step 626 to reset the linkage assembly 44 by moving the linkage assembly 44 to its initial position of FIG. 3 if it is not in its initial position.

Figure 14:
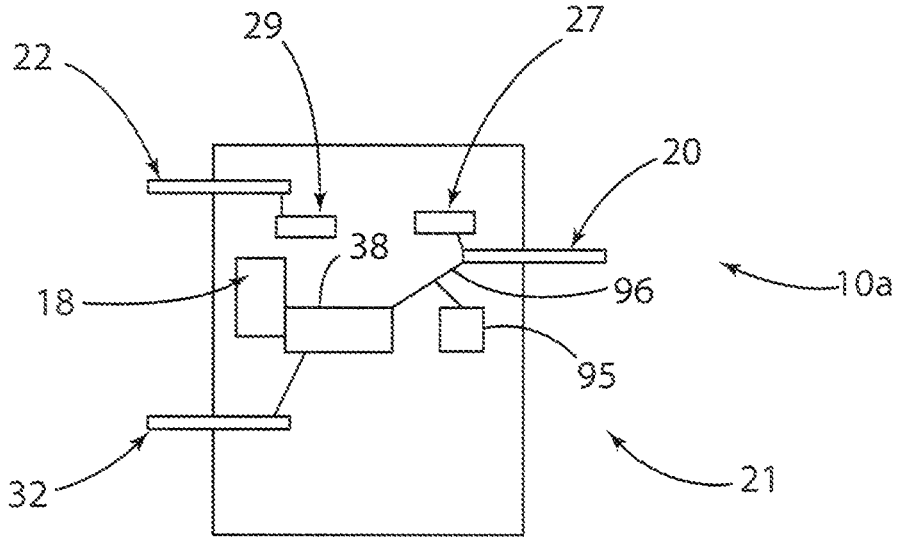
FIG. 14 is a schematic view of a latch system of a second embodiment of the present invention.

The reference numeral 10*a* (FIGS. 14-16) generally designates another embodiment of the present invention, having a second embodiment for the latch system. Since latch system 10*a* is similar to the previously described latch system 10, similar parts appearing in FIGS. 1-13 and FIGS. 14-16, respectively, are represented by the same, corresponding reference number. The second embodiment of the latch system 10*a* is substantially similar to the first embodiment of the latch system 10 except that a linkage assembly 96 between the inside handle 20 and the pawl 38 is a typical connection. As discussed in more detail below, instead of the linkage assembly 44 as discussed above, an electromagnetic lock 95 selectively interconnects the linkage assembly 96 with the pawl 38 and the inside handle 20, and the actuator 18 and the key unlatch cylinder 32 directly interact with the pawl 38 (e.g., by engaging an arm 98 of the pawl 38 to go against the bias of the pawl 38 along line 99 (see FIG. 16)).

Figure 15A:
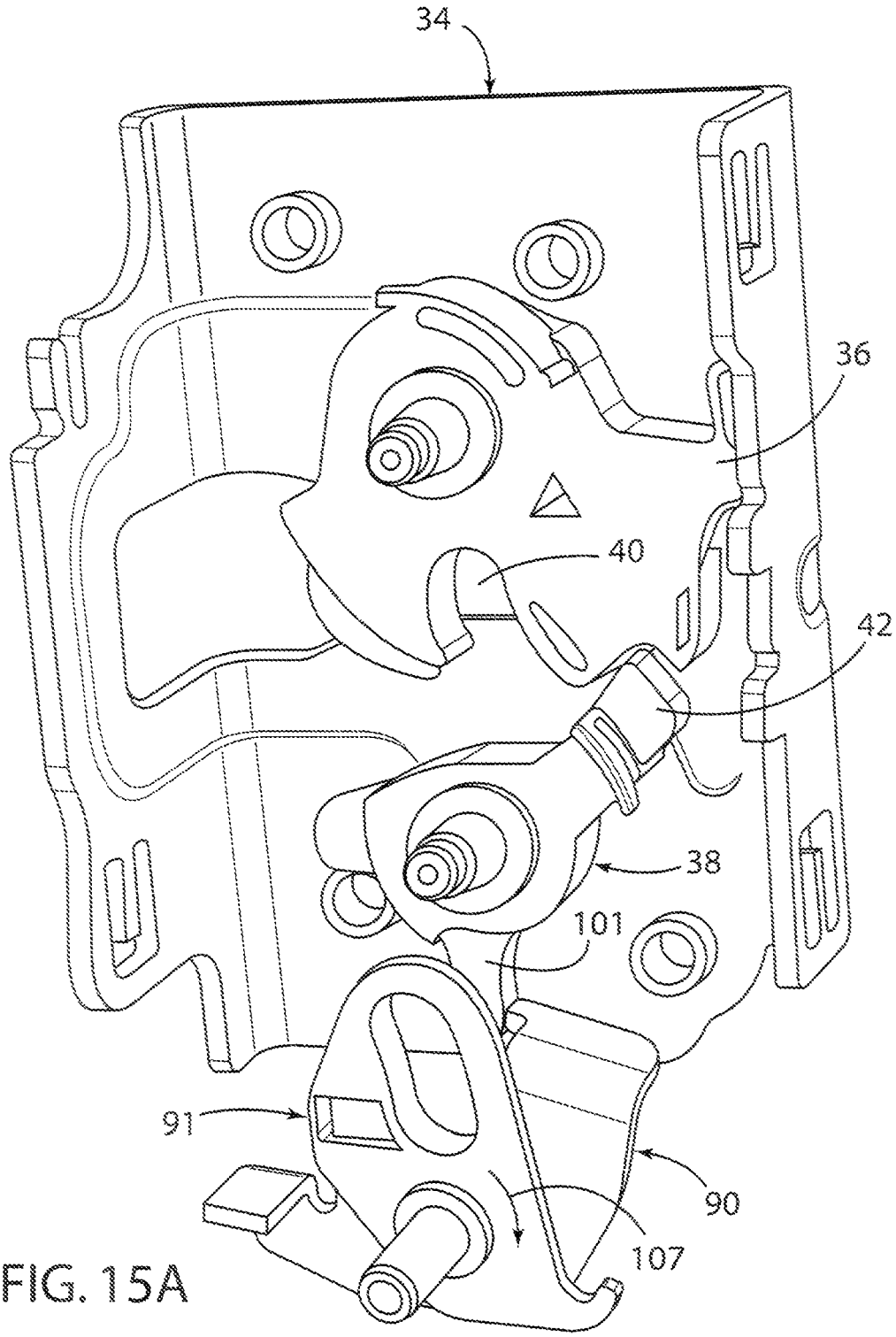
FIG. 15A is a partial perspective view of the typical latch for a door of FIG. 2 illustrating additional elements.
Figure 16:
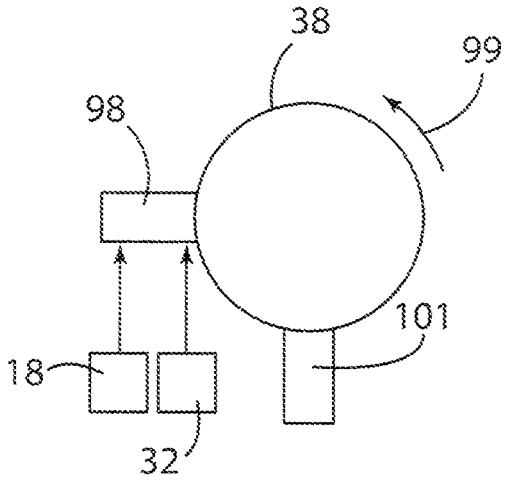
FIG. 16 is a schematic view of the second embodiment of the present invention showing movement of the pawl.

FIG. 15A illustrates the typical latch assembly 34 as discussed above in regard to FIG. 2 along with a release lever 90 and an intermediate release lever 91. The release lever 90 and the intermediate release lever 91 along with their structure and functions are well known to those skilled in the art. As illustrated in FIG. 15A, the release lever 90 and the intermediate release lever 91 are spring loaded away from the pawl 38 of the latch assembly 34 along line 107. The intermediate release lever 91 moves the release lever 90 to have the release lever 90 contact an arm 101 of the pawl 38 to release the catch 36 to thereby stop the pawl 38 from maintaining the catch 36 in the closed position.

Figure 15B:
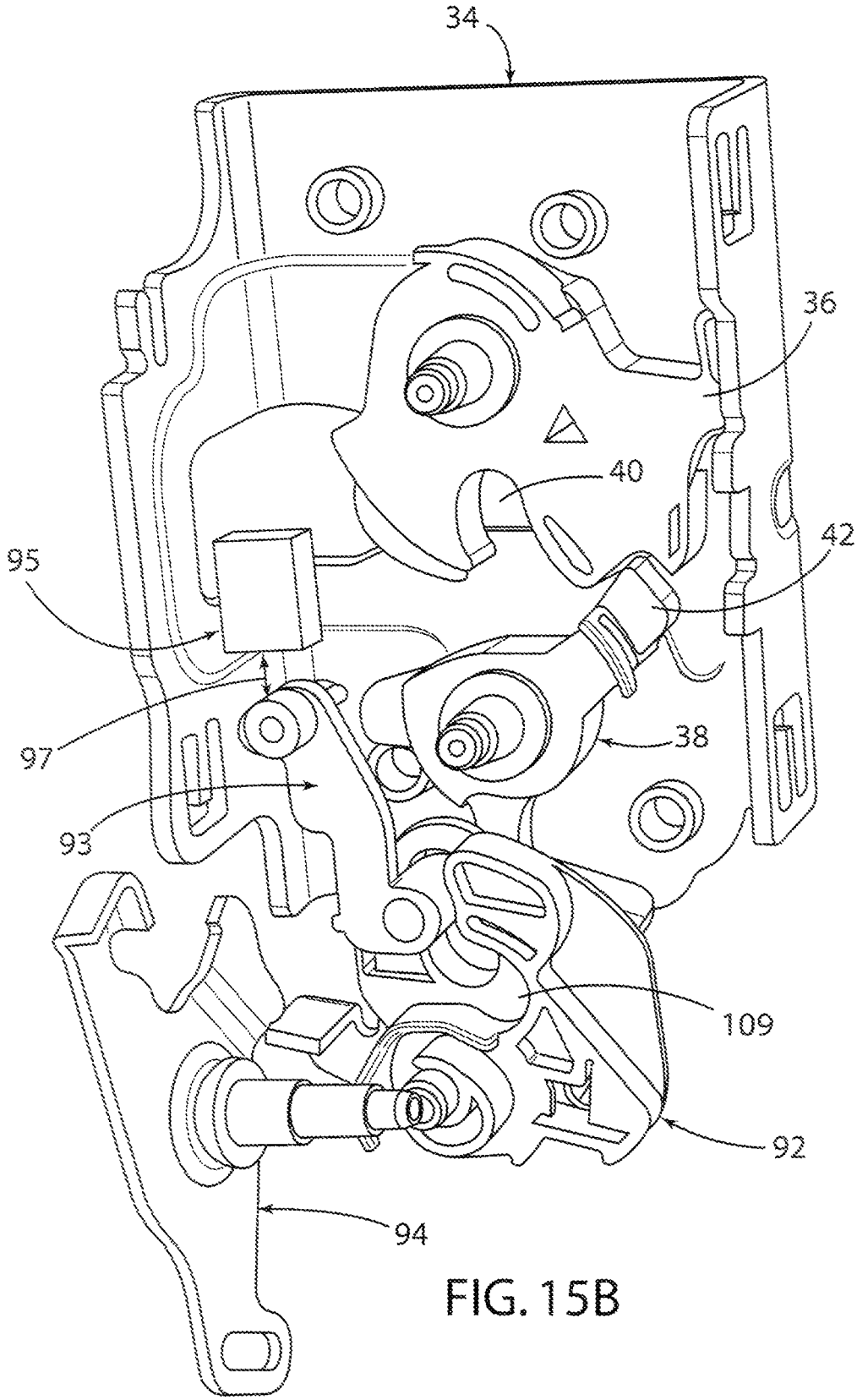
FIG. 15B is a partial perspective view of the typical latch for a door of FIG. 15A illustrating additional elements and an electromagnetic actuator of the second embodiment of the present invention.

FIG. 15B illustrates the typical latch assembly 34 as discussed above in regard to FIG. 15A along with a transition lever 92, a coupling lever 93 and an inside operating lever 94. The transition lever 92, the coupling lever 93 and the inside operating lever 94 along with their structure and functions are well known to those skilled in the art. As is well known to those skilled in the art, actuation of the inside handle 20 will cause the inside operating lever 94 to rotate. As illustrated in FIG. 15B, the coupling lever 93 is configured to move vertically. When the coupling lever 93 is in an unlocked position (up vertically as shown in FIG. 15B), rotation of the inside operating lever 94 will cause the coupling lever 93 to rotate the transition lever 92, thereby rotating the intermediate release lever 91 and the release lever 90 to thereby stop the pawl 38 from maintaining the catch 36 in the closed position. However, when the coupling lever 93 is in a locked position (down vertically as shown in FIG. 15B), rotation of the inside operating lever 94 will cause the coupling lever 93 to rotate, but the coupling lever 93 will move within a slot 109 in the transition lever 92, thereby not moving the transition lever 92 and not stopping the pawl 38 from maintaining the catch 36 in the closed position. As is well known to those skilled in the art, actuation of the inside handle 20 will cause the inside operating lever 94 to rotate. According to the present invention, the electromagnetic lock 95 will move the coupling lever 93 between the unlocked position and the locked position as shown by arrow 97. As used herein, the linkage assembly 96 includes any mechanical elements that can mechanically connect the inside handle 20 to the pawl 38. For example, the linkage mechanism 96 can include the release lever 90, the intermediate release lever 91, the transition lever 92, the coupling lever 93, the inside operating lever 94 and any interconnection between the inside operating lever 94 and the inside handle 20. However, it is contemplated that any of these items may be omitted or changed for the linkage assembly 96.

In the illustrated example, the electromagnetic lock 95 is configured to selectively hold the coupling lever 93 in the locked position such that only actuation of the actuator 18 will move to pawl 38 to unlock the latch. However, it is contemplated that the door module 14 could selectively allow the electromagnetic lock 95 to move the coupling lever 93 to the unlocked position to allow actuation of the inside handle 20 to mechanically move the pawl 38. Furthermore, the coupling lever 93 is biased to the unlocked position such that if the vehicle ever loses power, the electromagnetic lock 95 will no longer hold the coupling lever 93 in the locked position and the coupling lever 93 will move to the unlocked position, thereby allowing actuation of the inside handle 20 to mechanically move the pawl 38.

Referring next to FIGS. 17-20, flowcharts of a vehicle front/rear door inside/outside release operation of the second embodiment of the latch system 10*a* are provided.

Figure 17:
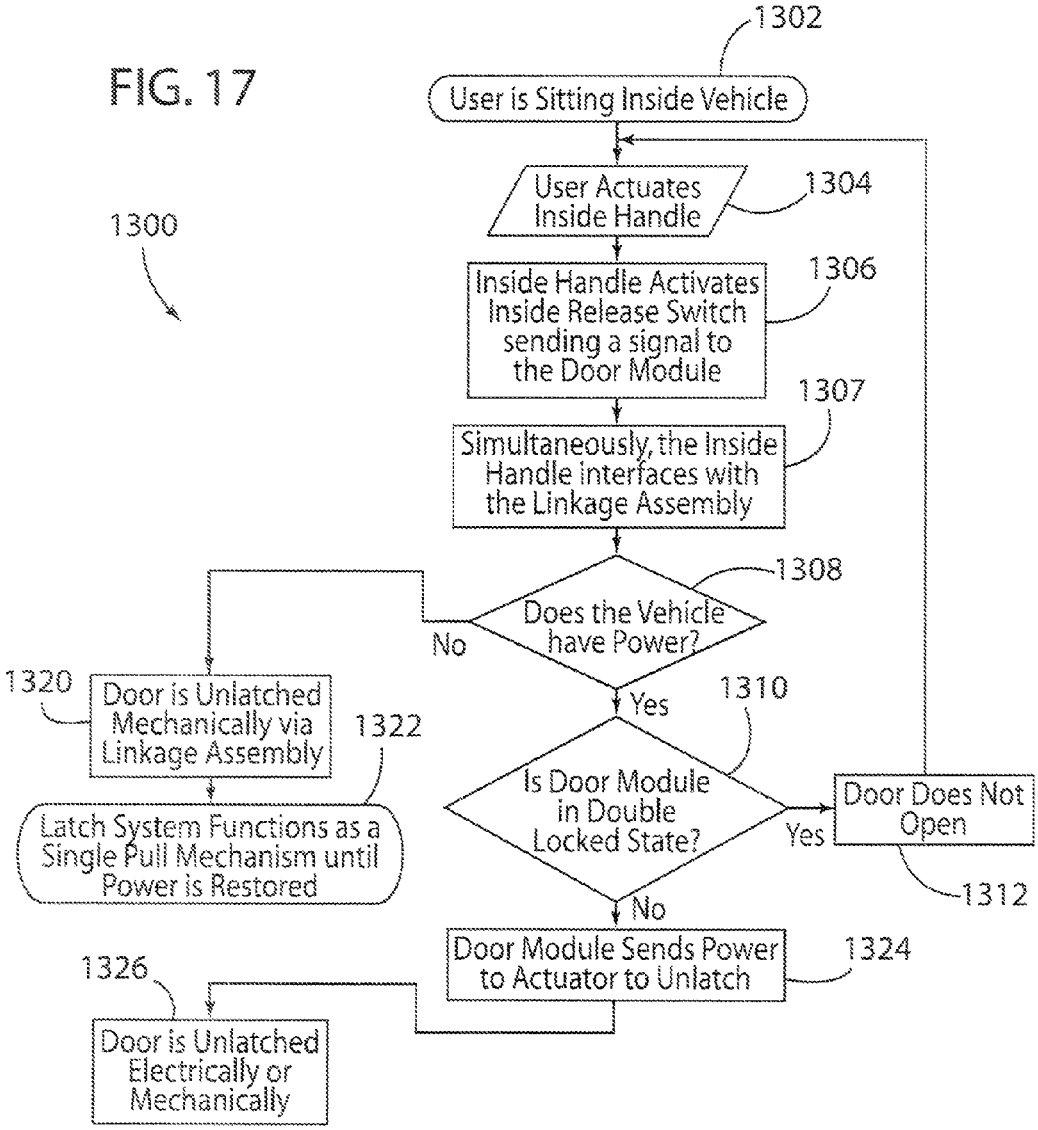
FIG. 17 is a flow chart illustrating a front door inside release operation of the second embodiment of the present invention.

Specifically, referring to FIG. 17, a front door inside release operation 1300 will be described in detail. For front door inside release operation 1300, at step 1302, a user is seated inside the vehicle, and at step 1304, the user actuates the inside handle 20. At step 1306, when the user actuates the inside handle 20, an inside release switch 27 is activated, thus sending a signal to the door module 14. Simultaneously, the inside handle 20 interfaces with the linkage assembly 96 at step 1307. At step 1308, if the vehicle has power, the method continues to step 1310. At step 1310, the door module 14 determines if the door module 14 is in a double locked state. If the determination at step 1308 is yes, then at step 1312, the vehicle door does not open. If the vehicle does not have power as determined at step 1308, then at step 1320, the door is unlatched mechanically via the linkage assembly 96 (as the electromagnetic lock 95 no longer maintains the door in a locked condition as discussed above) and the door is moved to the open location (thereby enabling a single pull functionality). Moreover, until the power is restored, the latch system 10*a* functions as a single pull mechanism at step 1322. If the determination at step 1310 is no (such that the door module 14 is not in a double locked state), the method 1300 continues to step 1324 where the door module 14 instructs the actuator 18 to move pawl 38 to allow the door to move to the open location at step 1326. It is noted that if it is desired to have the door open only after every two pulls of the inside handle 20, the door module 14 can be set to activate the actuator 18 only after every two pulls of the inside handle 20.

Figure 18:
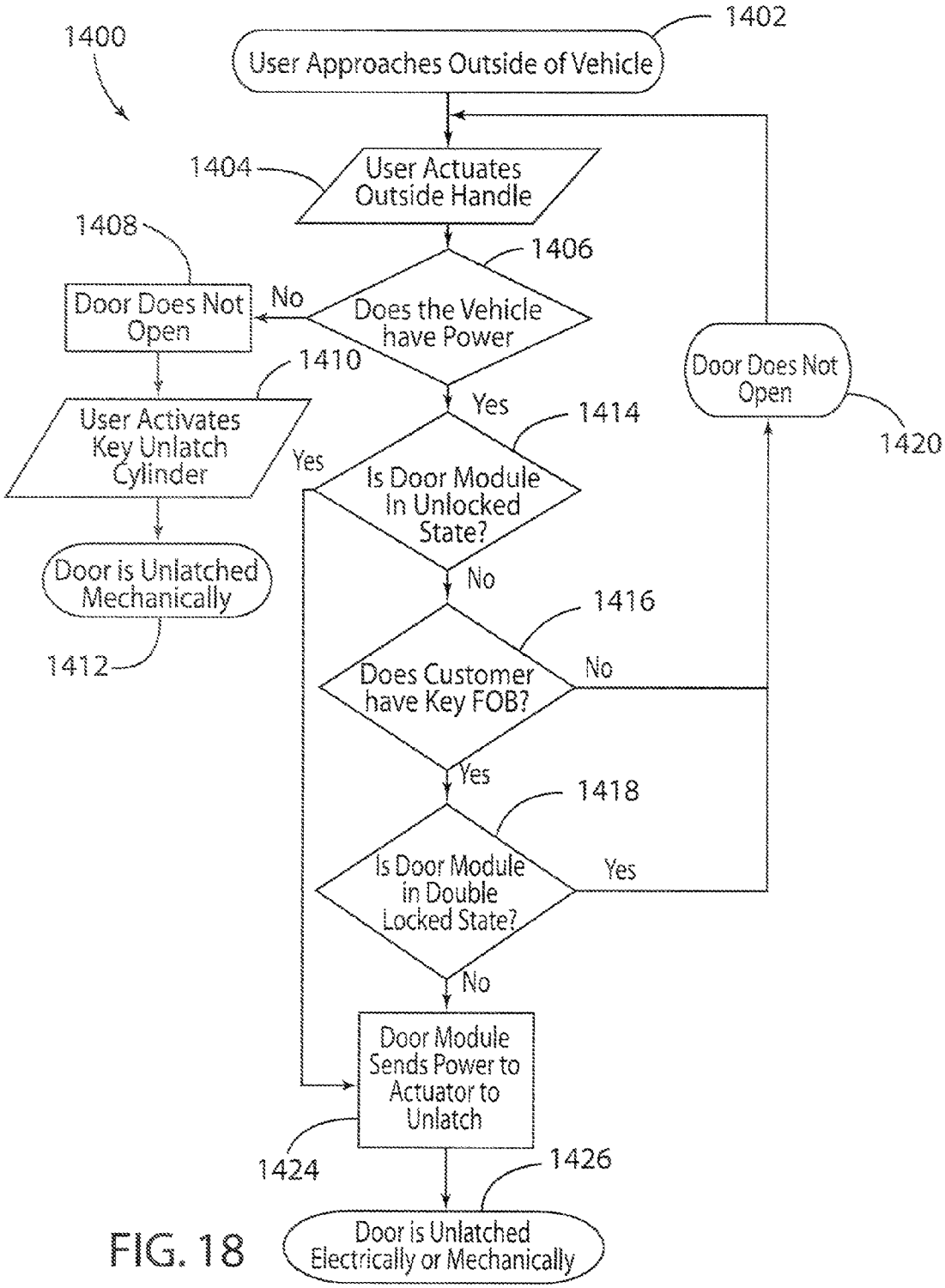
FIG. 18 is a flow chart illustrating a front door outside release operation of the second embodiment of the present invention.

Referring to FIG. 18, a front door outside release operation 1400 will be described in detail. For front door outside release operation 1400, at step 1402, a user approaches an outside of the vehicle, and at step 1404, the user actuates the outside handle 22. At step 1406, if the vehicle has no power, the method continues to step 1408. At step 1408, the door does not open until the user actuates the key unlatch cylinder 32 at step 1410 to mechanically move the door to the open location at step 1412. If the vehicle does have power as determined at step 1406, then at step 1414, the door module 14 determines if the door module 14 is in an unlocked state. If the determination at step 1414 is no, then at step 1416, the door module 14 determines if the user has a key FOB for moving the door module 14 to the unlocked state. If the user does not have a key FOB at step 1416, then at step 1420, the vehicle door does not open. If the user does have a key FOB at step 1416, at step 1418, the door module 14 determines if the door module 14 is a double locked state. If the door module 14 is in the double locked state, then at step 1420, the vehicle door does not open. If the determination at step 1418 is no (such that the door module 14 is not in a double locked state) or if the determination at step 1414 is yes (such that the door module 14 is in an unlocked state), the method 1400 continues to step 1424 where the door module 14 instructs the actuator 18 to move the pawl 38 to allow the door to move to the open location at step 1426.

Figure 19:
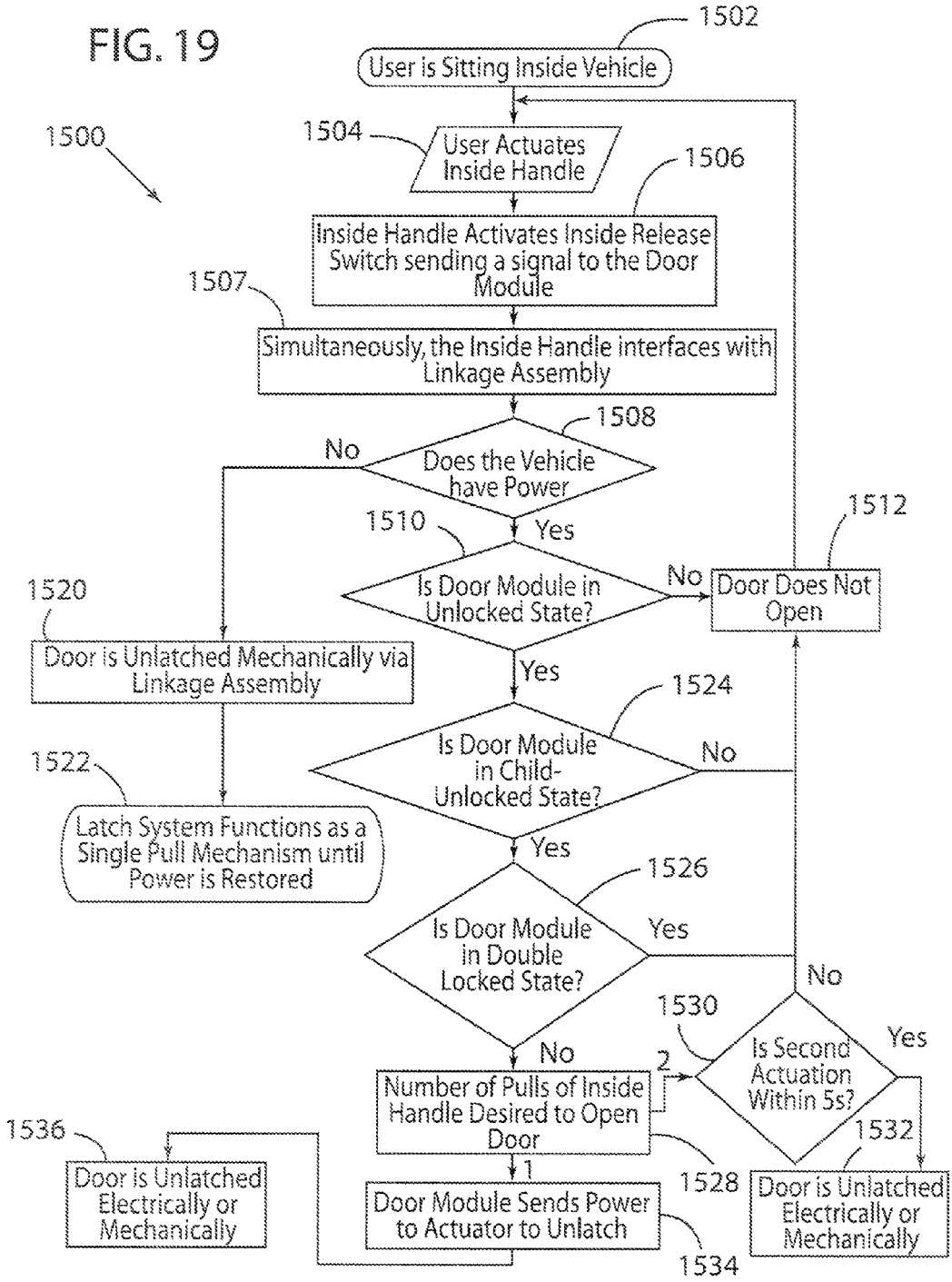
FIG. 19 is a flow chart illustrating a rear door inside release operation of the second embodiment of the present invention.

Referring to FIG. 19, a rear door inside release operation 1500 will be described in detail. For rear door inside release operation 1500, at step 1502, a user is seated inside the vehicle, and at step 1504, the user actuates the inside handle 20. At step 1506, when the user actuates the inside handle 20, an inside release switch is activated, thus sending a signal to the door module 14. Simultaneously, the inside handle 20 interfaces with the linkage assembly 96 at step 1507. At step 1508, if the vehicle does not have power, the method continues to step 1520. At step 1520, the door is unlatched mechanically via the linkage assembly 96 (as the electromagnetic lock 95 no longer maintains the door in a locked condition as discussed above) and the door is moved to the open location (thereby enabling a single pull functionality). Moreover, until the power is restored, the latch system 10 functions as a single pull mechanism at step 1522. If the vehicle does have power as determined at step 1508, then at step 1510, the door module 14 determines if the door module 14 is in an unlocked state. If the determination at step 1510 is no, then at step 1512, the vehicle door does not open. If the door module 14 is in the unlocked state as determined at step 1510, then at step 1524, the door module 14 determines if the door module 14 is in a child-unlocked state. If the determination at step 1524 is no, then at step 1512, the vehicle door does not open. If the door module 14 is in the child-unlocked state as determined at step 1524, then at step 1526, the door module 14 determines if the door module 14 is in a double locked state. If the determination at step 1526 is yes, then at step 1512, the vehicle door does not open. If the determination at step 1526 is no (such that the door module 14 is not in a double locked state), the method 1500 continues to step 1528 where the door module 14 determines the number of actuations of the inside handle 20 desired to open the door. If two actuations are desired as determined at step 1528, then the door module 14 determines if the second actuation is within a certain time period (e.g., 5 seconds) at step 1530. If the two actuations are within the certain time period, the door is unlatched mechanically (via the linkage assembly 96 as discussed above) or electrically using the actuator 18 at step 1532. However, if the two actuations are not within the certain time period, then at step 1512, the vehicle door does not open. If one actuation is desired as determined at step 1528, the method 1500 continues to step 1534 where the door module 14 instructs the actuator 18 to move the pawl 38 to allow the door to move to the open location at step 1536 or the inside handle 20 mechanically moves the pawl 38 using the linkage assembly 96 as discussed above (with the electromagnetic lock 95 being deactivated).

Figure 20:
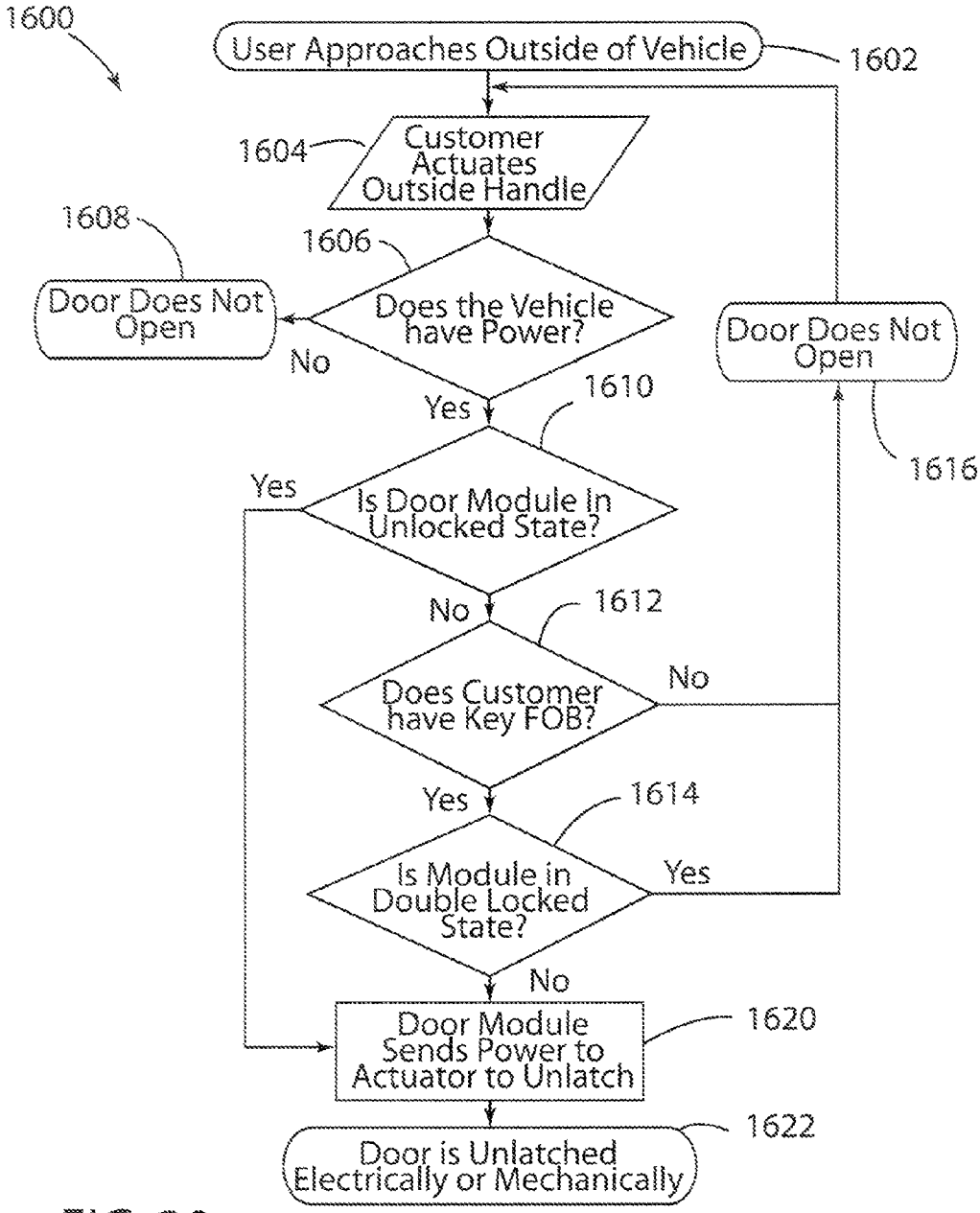
FIG. 20 is a flow chart illustrating a rear door outside release operation of the second embodiment of the present invention.

Referring to FIG. 20, a rear door outside release operation 1600 will be described in detail. For rear door outside release operation 1600, at step 1602, a user approaches an outside of the vehicle, and at step 1604, the user actuates the outside handle 22. At step 1606, if the vehicle has no power, the method continues to step 1608, where the door does not open. If the vehicle does have power as determined at step 1606, then at step 1610, the door module 14 determines if the door module 14 is in an unlocked state. If the determination at step 1610 is no, then at step 1612, the door module 14 determines if the user has a key FOB for moving the door module 14 to the unlocked state. If the user does not have a key FOB at step 1612, then at step 1616, the vehicle door does not open. If the user does have a key FOB at step 1612, at step 1614, the door module 14 determines if the door module 14 is in a double locked state. If the door module 14 is in the double locked state, then at step 1616, the vehicle door does not open. If the determination at step 1614 is no (such that the door module 14 is not in a double locked state) or if the determination at step 1610 is yes (such that the door module 14 is in an unlocked state), the method 1600 continues to step 1620 where the door module 14 instructs the actuator 18 to move the pawl 38 to allow the door to move to the open location or the inside handle 20 mechanically moves the pawl 38 using the linkage assembly 96 as discussed above (with the electromagnetic lock 95 being deactivated) at step 1622.

To summarize, latch systems 10 and 10*a* thus provide a universal door latching system which may be readily operable by electronic door module 14 for meeting different government regulations or customer requirements. For example, the latch systems 10 and 10*a* may be operable to include a rear door latch override as allowed in Europe, and maintain the rear door latch override function for the U.S. or similar markets. The latch systems 10 and 10*a* may also be readily adaptable for feature upgrades (e.g., power child locks, fast unlock, etc.), and require minimal modifications for design aspects involving mounting hole patterns, electrical connectors, rod versus handles, etc. Thus, the latch systems 10 and 10*a* provide a common front and side door latch system on a global scale, while also reducing product development time, costs and tooling related to side door latches.

The latch systems may support both fixed and moving outside handle applications with no change to the latch. Yet further, as also discussed above, the door module 14 may provide multiple functionalities depending on the signal(s) received from the outside and inside release handles upon activation. In a particular embodiment, the outside handle may be a purely electrical release. Yet further, the latch assembly 12 may include no lock levers, and the latch system 10 may be purely within the memory of the door module 14. The power child lock function may be provided by the logic of the door module 14, with no additional motors or child-lock levers in the latch assembly 12.

It is to be understood that variations and modifications can be made on the aforementioned structure without departing from the concepts of the present invention. For example, it is contemplated that the door module 14 could be configured to only allow the door to move to the open location if the vehicle is traveling below a certain speed (e.g., 3 miles per hour) and/or if no crash is detected. Further, it is to be understood that such concepts are intended to be covered by the following claims unless these claims by their language expressly state otherwise.

We claim:

1. A latch system for a door of a vehicle comprising:

a latch assembly for maintaining the door in a closed position, the latch assembly including a catch and a pawl, the catch having a closed position wherein the catch is configured to grasp a portion of the vehicle to maintain the door in the closed position and an open position wherein the catch is configured to release the portion of the vehicle to allow the door to move to an open position, the pawl being configured to maintain the catch in the closed position;

an actuatable inside handle movable from a rest position to an actuated position;

a linkage assembly mechanically linked between the inside handle and the latch assembly; and an actuator interconnected to the pawl, the actuator being configured to be activated by actuation of the inside handle;

wherein, when the vehicle has power, the catch is configured to be moved to the open position after actuation of the inside handle by activating the actuator to thereby move the pawl to stop the pawl from maintaining the catch in the closed position;

wherein, when the vehicle has power, the catch is also configured to be moved to the open position after actuation of the inside handle by having the inside handle mechanically move the linkage assembly to stop the pawl from maintaining the catch in the closed position; and wherein, when the vehicle does not have power, the catch is configured to be moved to the open position by having the inside handle mechanically move the linkage assembly to stop the pawl from maintaining the catch in the closed position upon first and second actuations of the inside handle, each of the first and second actuations comprising movement of the inside handle from the rest position to the actuated position, whereby the catch is allowed to move the open position upon the second actuation of the inside handle.

2. The latch system for a door of a vehicle as claimed in claim 1, wherein:

the linkage assembly includes at least one rotary gear located between the inside handle and the pawl of the latch assembly;

the at least one rotary gear includes a first gear and a second gear; and the second gear engages the pawl to stop the pawl from maintaining the catch in the closed position.

3. The latch system for a door of a vehicle as claimed in claim 2, wherein:

the linkage assembly further includes a linearly movable member configured to move linearly, the movable member being engaged with the first gear to rotate the first gear, and the first gear being engaged with the second gear to rotate the second gear.

4. The latch system for a door of a vehicle as claimed in claim 3, wherein:

the actuator engages with at least one of the first gear, the second gear and the linearly movable member to move the linkage assembly.

5. The latch system for a door of a vehicle as claimed in claim 1, further including:

a key unlatch cylinder configured to be accessible from an exterior of the vehicle, the key unlatch cylinder being configured to be actuated after engagement with a key, the key unlatch cylinder being engaged with the linkage assembly; and wherein the catch is configured to be moved to the open position after actuation of the key unlatch cylinder to thereby move the linkage assembly to stop the pawl from maintaining the catch in the closed position.

6. The latch system for a door of a vehicle as claimed in claim 1, wherein:

the actuator is configured to be able to move the linkage assembly to engage the pawl to thereby have the pawl maintain the catch in the closed position.

7. A method of controlling a position of a door of a vehicle comprising:

providing a latch assembly including a catch and a pawl, the catch having a closed position wherein the catch is configured to grasp a portion of the vehicle to maintain the door in a closed position and an open position wherein the catch is configured to release the portion of the vehicle to allow the door to move to an open position;

providing an actuatable inside handle movable from a rest position to an actuated position;

mechanically linking a linkage assembly between the inside handle and the latch assembly; and interconnecting an actuator to the pawl;

wherein, when the vehicle has power, allowing the door to move to the open position by actuating the inside handle to activate the actuator to move the pawl to thereby stop the pawl from maintaining the catch in the closed position;

wherein, when the vehicle has power, allowing the door to move to the open position by actuating the inside handle to directly mechanically move the linkage assembly to thereby stop the pawl from maintaining the catch in the closed position; and wherein, when the vehicle does not have power, allowing the door to move to the open position by actuating the inside handle a first time by moving the inside handle from the rest position to the actuation position and a second time by moving the inside handle from the rest position to the actuation position to mechanically move the linkage assembly to thereby stop the pawl from maintaining the catch in the closed position and allow the catch to move to the open position.

8. The method of controlling a location of a door of a vehicle as claimed in claim 7, wherein:

the linkage assembly includes a linearly movable member configured to move linearly, a first gear and a second gear;

the inside handle is engaged with the movable member to move the movable member;

the movable member is engaged with the first gear to rotate the first gear; and the first gear being engaged with the second gear to rotate the second gear.

9. A vehicle door system comprising:

an assembly for maintaining a door closed;

a handle mechanically connected to the assembly;

an actuator interconnected to the assembly;

the assembly being placed in an open condition after actuation of the handle via the actuator or mechanically when the vehicle has power; and the handle mechanically placing the assembly in the open condition only after two full actuations of the handle when the vehicle does not have power.

* * * * *